US009738497B2

(12) United States Patent
Nakamura et al.

(10) Patent No.: US 9,738,497 B2
(45) Date of Patent: Aug. 22, 2017

(54) JIB ATTACHMENT/DETACHMENT MECHANISM

(71) Applicant: TADANO LTD., Kagawa (JP)

(72) Inventors: Masafumi Nakamura, Takamatsu (JP); Hiroshi Takashima, Takamatsu (JP)

(73) Assignee: TADANO LTD., Kagawa (JP)

( * ) Notice: Subject to any disclaimer, the term of this patent is extended or adjusted under 35 U.S.C. 154(b) by 183 days.

(21) Appl. No.: 14/294,189

(22) Filed: Jun. 3, 2014

(65) Prior Publication Data

US 2014/0353272 A1 Dec. 4, 2014

(30) Foreign Application Priority Data

Jun. 3, 2013 (JP) ..... 2013-117247

(51) Int. Cl.
*B66C 23/70* (2006.01)
*B66C 23/66* (2006.01)

(52) U.S. Cl.
CPC ..... *B66C 23/70* (2013.01); *B66C 23/66* (2013.01); *B66C 23/702* (2013.01)

(58) Field of Classification Search
CPC ..... B66C 23/66; B66C 23/70; B66C 23/702; B66C 23/00; B66C 23/06; B66C 23/34; B66C 23/342; B66C 23/344; B66C 23/348; B66C 23/62; B66C 23/64; B66C 23/701
See application file for complete search history.

(56) References Cited

U.S. PATENT DOCUMENTS 3,732,988 A * 5/1973 Lamer ..... B66C 23/702 212/300
3,945,333 A * 3/1976 Fritsch ..... B66C 23/702 212/177
3,968,884 A * 7/1976 Johnson ..... B66C 23/702 212/300
4,431,109 A * 2/1984 Behrendt ..... B66C 23/702 212/177

(Continued)

FOREIGN PATENT DOCUMENTS

CN 101817479 A 9/2010
CN 102897677 A 1/2013

(Continued)

OTHER PUBLICATIONS

The extended European search report issued by the European Patent Office on Oct. 6, 2014, which corresponds to European Patent Application No. 14170822.2-1705 and is related to U.S. Appl. No. 14/294,189.

(Continued)

*Primary Examiner* — Sang Kim
*Assistant Examiner* — Juan Campos, Jr.
(74) *Attorney, Agent, or Firm* — Studebaker & Brackett PC

(57) ABSTRACT

A jib attachment/detachment mechanism to mount a jib on a boom head includes a guide mechanism including a guide roller and a guide support configured to guide engaging portions of a jib support to positions of engagement with shaft pins of a boom head when the jib support is pulled up with a wire by using a winch and to prevent change of a state of the wire pulled up by the winch when the jib support is rotated around the shaft pins by contracting a cylinder.

4 Claims, 26 Drawing Sheets

(56) References Cited

U.S. PATENT DOCUMENTS

| | | | | |
|---|---|---|---|---|
| 4,491,229 | A * | 1/1985 | Behrendt | B66C 23/702 212/177 |
| 2010/0213152 | A1 | 8/2010 | Martin et al. | |
| 2014/0027398 | A1 * | 1/2014 | Willim | B66C 23/365 212/177 |

FOREIGN PATENT DOCUMENTS

| | | | |
|---|---|---|---|
| JP | H09-058976 | A | 3/1997 |
| JP | 10-316369 | A | 12/1998 |
| JP | 2000-153992 | A | 6/2000 |
| JP | 2000-318978 | A | 11/2000 |
| JP | 2007-022790 | A | 2/2007 |
| JP | 2011-121671 | A | 6/2011 |

OTHER PUBLICATIONS

The First Office Action issued by the Chinese Patent Office on Dec. 2, 2016, which corresponds to Chinese Patent Application No. 201410242471.3 and is related to U.S. Appl. No. 14/294,189.

JP Office Action dated Feb. 21, 2017 from corresponding JP Appl No. 2013-117247, 2 pp.

* cited by examiner

JIB ATTACHMENT/DETACHMENT MECHANISM

CROSS-REFERENCE TO RELATED APPLICATION

This application claims priority from Japanese Patent Application No. 2013-117247 filed on Jun. 3, 2013, the disclosure of which is herein incorporated by reference.

BACKGROUND OF THE INVENTION

Field of the Invention

The present invention relates to a jib attachment/detachment mechanism for detachably attaching a jib on a tip portion of a boom.

Description of the Related Art

Conventionally, an attachment/detachment mechanism for detachably mounting a jib support provided to a rear portion of a jib main body on a boom head provided to a tip of a boom has been known (see Japanese Patent Application Publication No. 2000-153992).

In such an attachment/detachment mechanism, a cylinder for attachment and detachment is provided to the jib, a movable sheave is provided to a movable side of the cylinder for attachment and detachment, and a fixed sheave is provided to a base end portion of the jib. When the cylinder for attachment and detachment extends, the movable sheave is moved in the extension direction to pull wires. Thus, the fixed sheave is pulled up, and the jib is mounted onto a tip portion of the boom.

However, the attachment/detachment mechanism has a problem of requiring provision of a dedicated attachment/detachment cylinder for mounting the jib support on the boom head.

SUMMARY OF THE INVENTION

An object of the present invention is to provide a jib attachment/detachment mechanism which eliminates the need for a dedicated attachment/detachment cylinder.

To accomplish the above object, a jib attachment/detachment mechanism according to one embodiment of the present invention includes:

a first connecting portion provided to an upper portion of a tip of a boom head;

a second connecting portion provided to an upper portion of a rear end of a jib support provided rotatably in a rear portion of a jib main body, the second connecting portion configured to be detachably connected to the first connecting portion;

a locking portion provided to one of a lower portion of the tip of the boom head and a lower portion of the rear end of the jib support; and an engaging portion provided to the other one of the lower portions and configured to engage with the locking portion.

A jib is mounted on the boom head such that the engaging portion or the locking portion provided to the lower portion of the jib support is engaged with the locking portion or the engaging portion provided to the lower portion of the tip of the boom head by lying the jib main body with a cylinder for luffing the jib main body being extended, and pulling up the jib support, together with the rear portion of the jib main body, with a wire by using a winch, and then the second connecting portion is connected to the first connecting portion by contracting the cylinder to rotate the jib support around the locking portion by a predetermined amount.

The jib attachment/detachment mechanism includes a guide mechanism configured to guide the engaging portion or the locking portion of the jib support to a position of engagement with the locking portion or the engaging portion of the boom head when the jib support is pulled up with the wire by using the winch, and to prevent change of a state of the wire being pulled up by the winch when the jib support is rotated around the locking portion by contracting the cylinder.

DETAILED DESCRIPTION OF THE EMBODIMENT

Hereinafter, description is given of an embodiment of an attachment/detachment mechanism for detachably mounting a jib on a tip portion of a telescopic boom of a turnable boom operation machine according to the present invention on the basis of the drawings.

Figure 1:
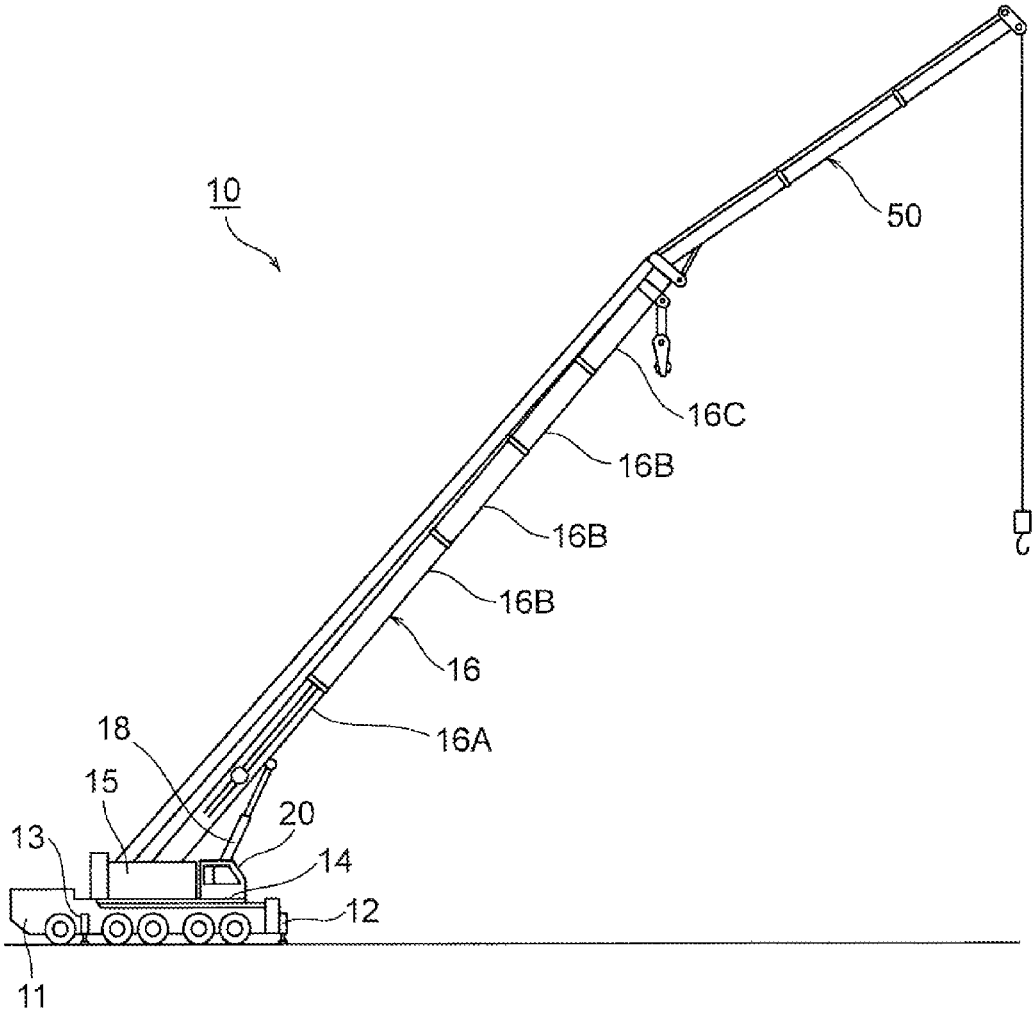
FIG. 1 is a side view showing a mobile crane in which a jib is mounted by an attachment/detachment mechanism according to the present invention.

FIG. 1 shows an all terrain crane 10 in which a jib 50 is mounted at a tip of a tip boom 16C.

The all terrain crane 10 (hereinafter referred to as crane) includes a carrier 11 being a main body portion of a vehicle and capable of traveling, a pair of left and right front outriggers 12 provided in a front side of the carrier 11, and a pair of left and right rear outriggers 13 provided in a rear side of the carrier 11, a turn table 14 horizontally turnably attached to an upper portion of the carrier 11, a cabin 20 provided to the turn table 14, a bracket 15 fixed to the turn table 14, a telescopic boom 16 attached to the bracket 15, and the like.

The telescopic boom 16 has a base end portion attached by a supporting shaft (not illustrated), and is capable of luffing around the supporting shaft. A luffing cylinder 18 is set between the bracket 15 and the telescopic boom 16, and the telescopic boom 16 is luffed by extension or contraction of the luffing cylinder 18.

The telescopic boom 16 has multiple booms including a base boom 16A, multiple intermediate booms 16B, and the tip boom 16C, which are nested in the base boom 16A in this order from the outside to the inside. The telescopic boom 16 is configured to extend and contract by an extension cylinder (not illustrated).

Figure 2:
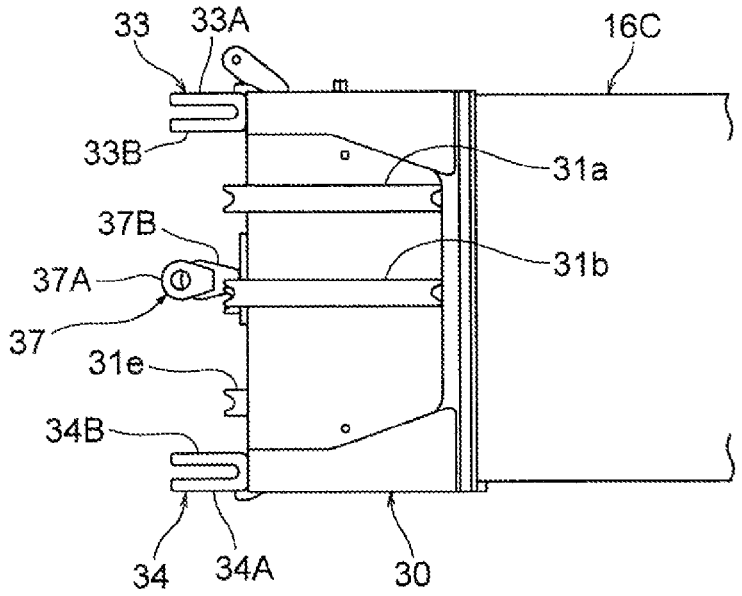
FIG. 2 is a plan view showing a boom head provided to a tip portion of a tip boom.
Figure 3:
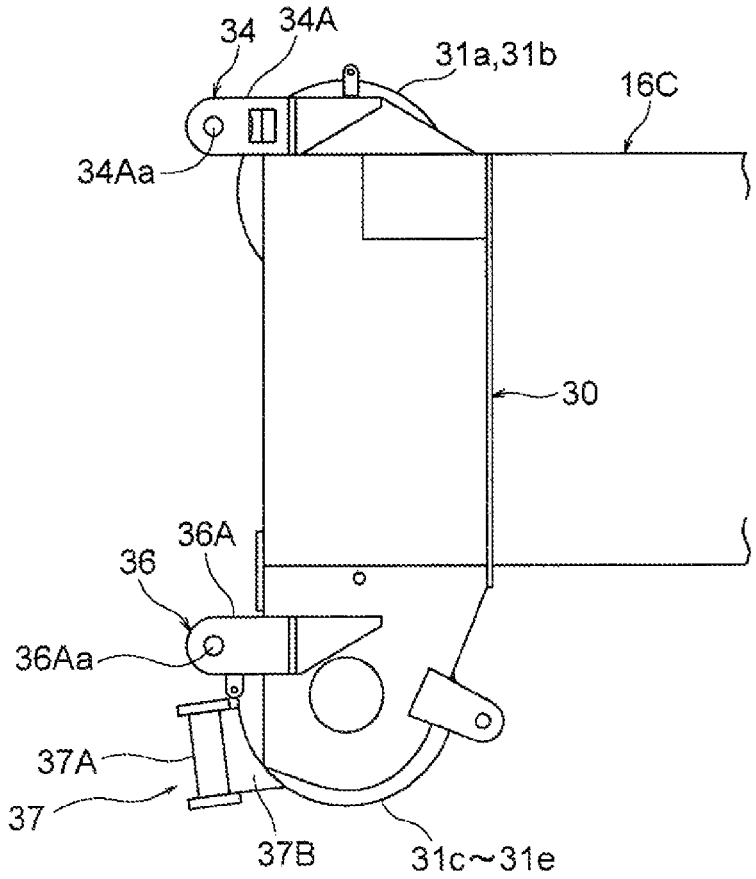
FIG. 3 is a side view showing the boom head shown in FIG. 2.
Figure 4:
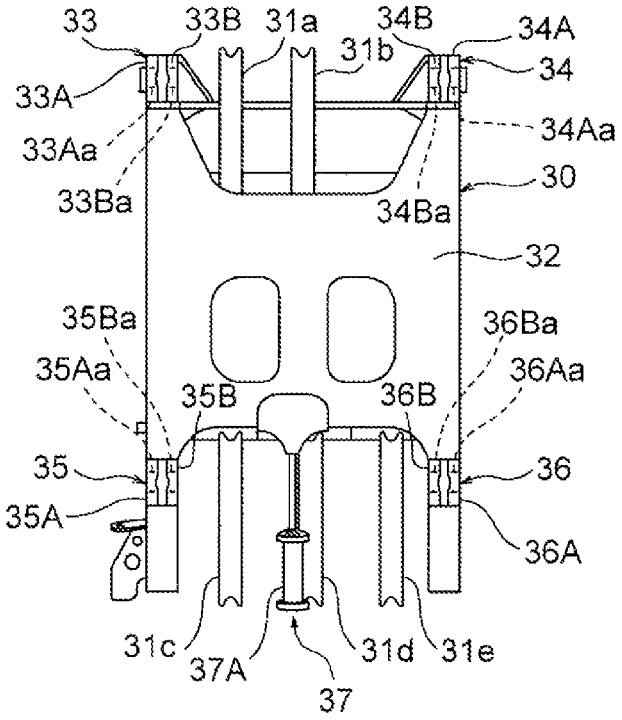
FIG. 4 is a front view of the boom head shown in FIG. 2.

As shown in FIGS. 2 to 4, the tip boom 16C is provided with a boom head 30, and the boom head 30 is provided with multiple sheaves 31*a* to 31*d*.

An end plate 32 is provided to a tip of the boom head 30, and connecting portions (first connecting portions) 33 and 34 are provided on both sides in an upper portion (in FIG. 4) of the end plate 32. Each of the connecting portions 33 and 34 includes a pair of connecting plates 33A and 33B or 34A and 34B, each pair of which face each other, and pin-insertion holes 33Aa, 33Ba, 34Aa, and 34Ba are formed in the connecting plates 33A, 33B, 34A, and 34B, respectively.

Likewise, shaft holding portions 35 and 36 are provided on both sides in a lower portion of the end plate 32. Each of the shaft holding portions 35 and 36 includes a pair of shaft holding plates 35A and 35B or 36A and 36B, each pair of which face each other, and pin insertion holes 35Aa, 35Ba, 36Aa, and 36Ba are formed in the shaft holding plates 35A, 35B, 36A, and 36B, respectively. Shaft pins (locking portions) P1 and P1 described later are to be inserted through the pin insertion holes 35Aa, 35Ba, 36Aa, and 36Ba of the shaft holding plates 35A, 35B, 36A, and 36B.

Figure 5:
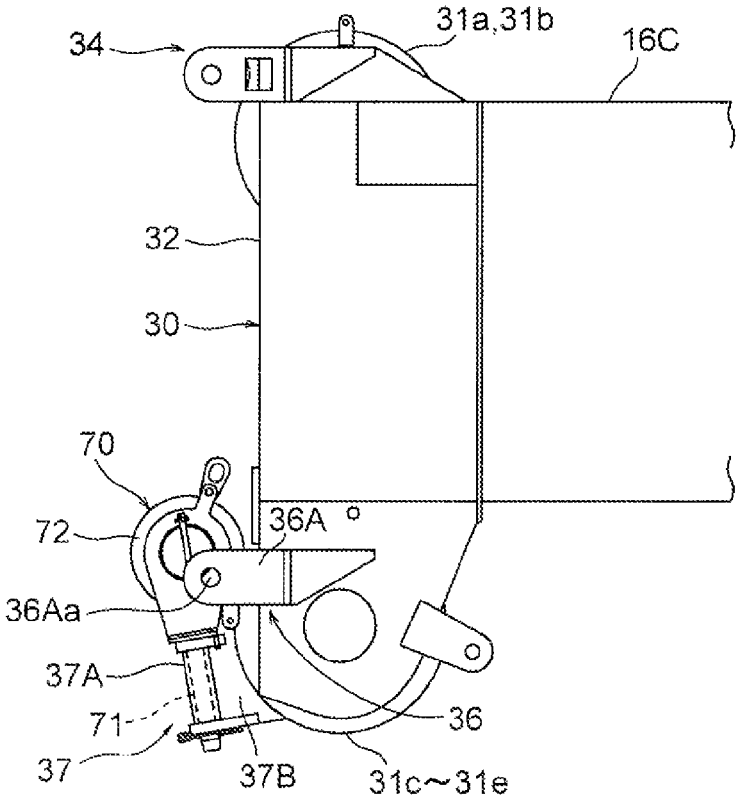
FIG. 5 is a side view of the boom head holding a guide roller.

In addition, a holding portion 37 for holding a guide roller (guided member) 70 described later is provided to a center portion of the lower portion of the end plate 32. The holding portion 37 has a tubular portion (second tubular portion) 37A and a supporting wall 37B fixing the tubular portion 37A to the end plate 32. As shown in FIG. 5, a supporting rod 71 of the guide roller 70 is to be inserted into the tubular portion 37A to detachably hold the guide roller 70 by the holding portion 37.

[Jib]

Figure 6:
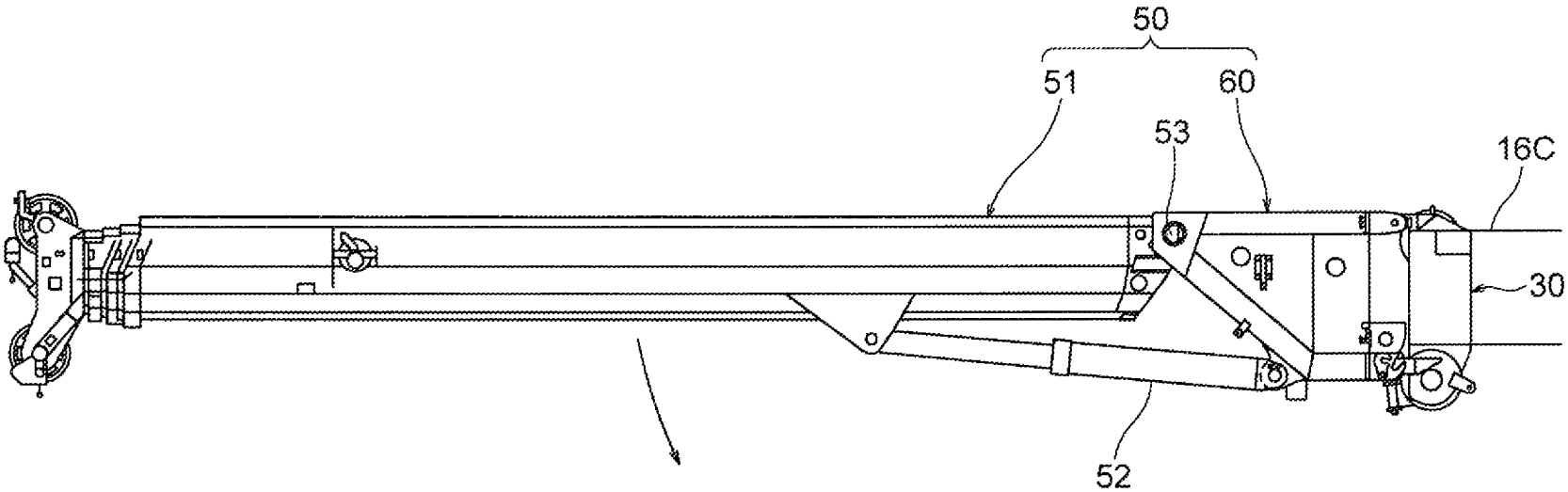
FIG. 6 is a side view showing the jib mounted on the boom head.

As shown in FIG. 6, the jib 50 has a jib main body 51, a jib support 60 provided rotatably to a rear of the jib main body 51, and a cylinder 52 for luffing the jib main body 51 with respect to the jib support 60.

An extension or contraction operation of the cylinder 52 causes the jib main body 51 to rotate around a shaft 53 with respect to the jib support 60 and luff with respect to the jib support 60. FIG. 6 shows a state where the cylinder 52 is extended. When the cylinder 52 contracts from this state, the jib main body 51 rotates with respect to the jib support 60 around the shaft 53 in the direction of the arrow.

Figure 7:
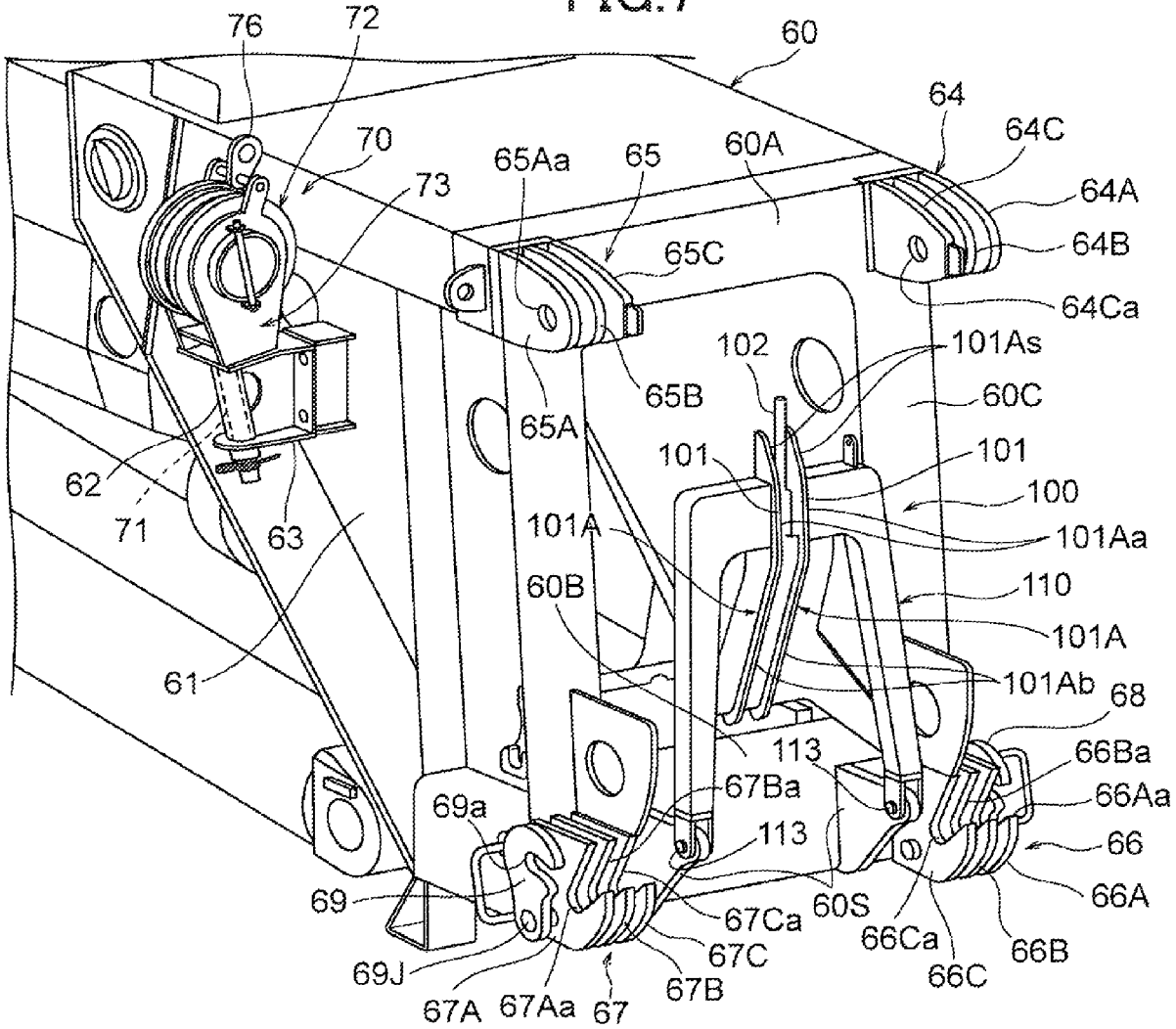
FIG. 7 is a perspective view showing a structure of a jib support.
Figure 8:
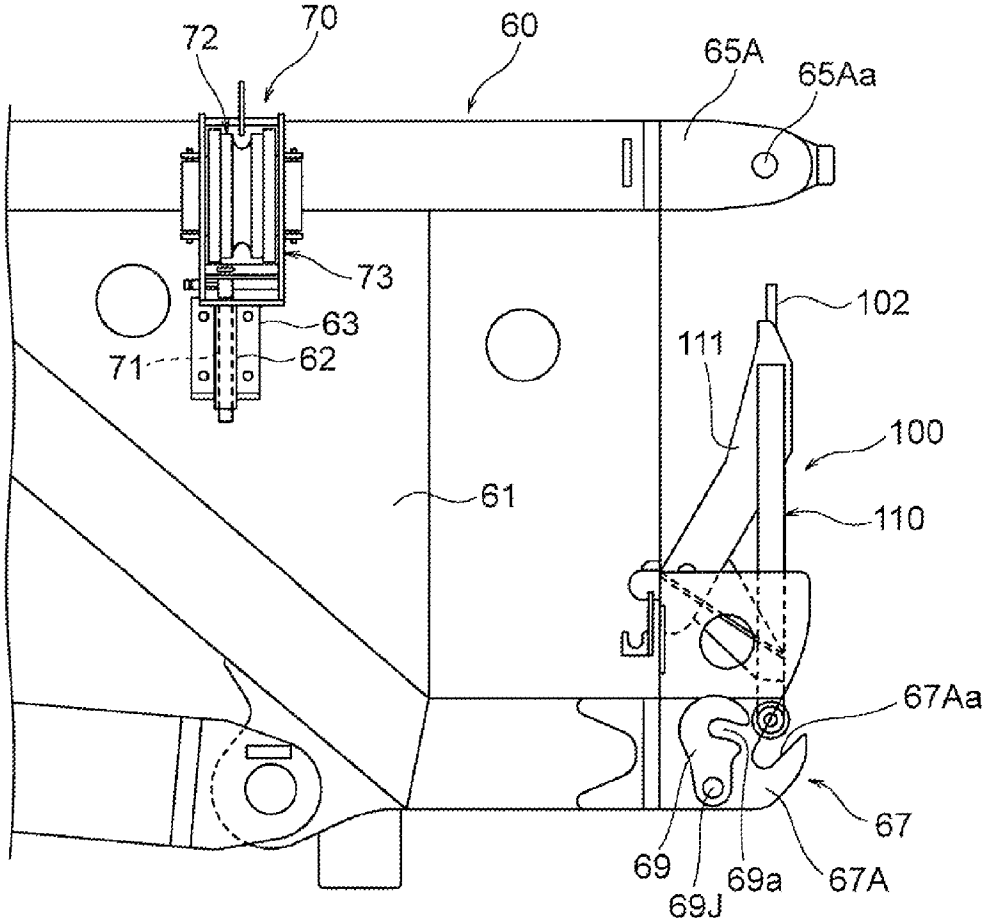
FIG. 8 is a side view of the jib support shown in FIG. 7.
Figure 9:
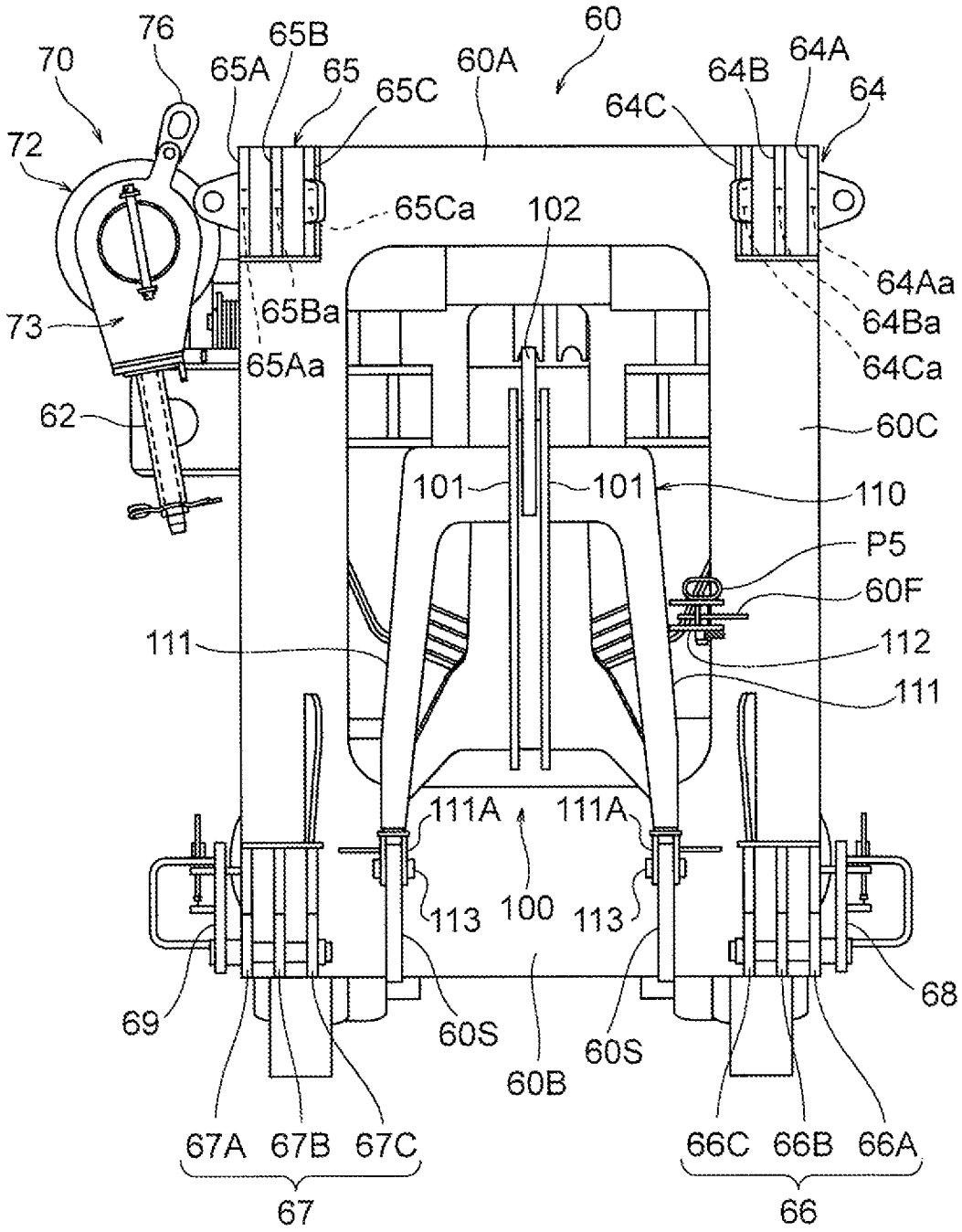
FIG. 9 is a back view of the jib support shown in FIG. 7.

As shown in FIGS. 7 to 9, the guide roller 70 is detachably attached to one side portion of the jib support 60, and a guide support (guide unit) 100 is provided in a rear end of the jib support 60.

Here, the guide roller 70 and the guide support 100 constitute a guide mechanism.

[Jib Support]

As shown in FIGS. 7 and 8, the jib support 60 has a tubular bearing portion (first tubular portion) 62 held by a bracket 63 provided on a sidewall 61.

The supporting rod 71 of the guide roller 70 is detachably inserted into the bearing portion 62 to hold the guide roller 70 by the bearing portion 62.

Connecting portions (second connecting portions) 64 and 65 to be connected to the connecting portions 33 and 34 of the boom head 30 are provided on both ends of an upper wall portion 60A in the rear end of the jib support 60.

Figure 10:
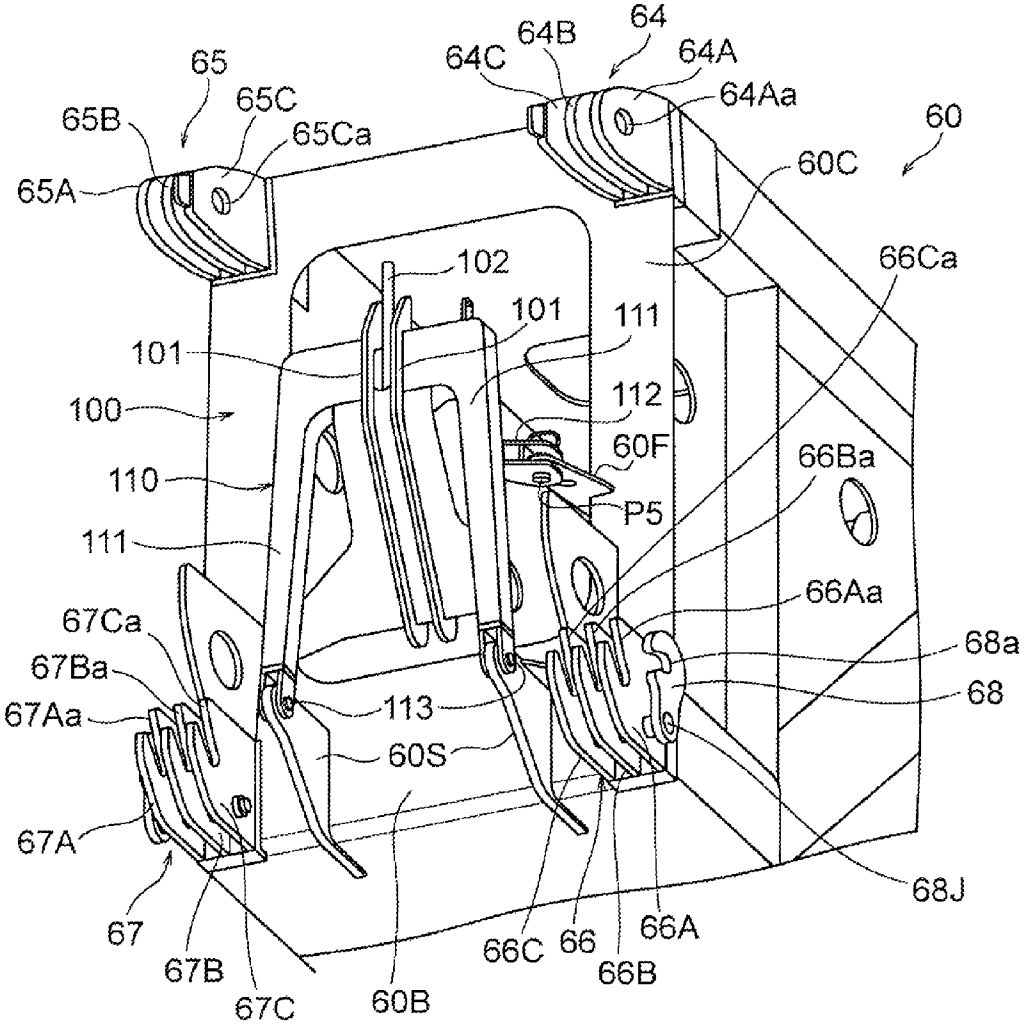
FIG. 10 is a perspective view of the jib support.

As shown in FIGS. 7, 9, and 10, the connecting portion 64 has three connecting plates 64A to 64C arranged at predetermined intervals. Pin insertion holes 64Aa to 64Ca are formed in the connecting plates 64A to 64C, respectively.

In addition, the connecting plate 33A of the connecting portion 33 of the boom head 30 is to be inserted between the connecting plate 64A and the connecting plate 64B, and the connecting plate 33B of the connecting portion 33 is to be inserted between the connecting plate 64B and the connecting plate 64C.

Meanwhile, as shown in FIGS. 7, 9, and 10, the connecting portion 65 has three connecting plates 65A to 65C arranged at predetermined intervals. Pin insertion holes 65Aa to 65Ca are formed in the connecting plates 65A to 65C, respectively.

In addition, the connecting plate 34A of the connecting portion 34 of the boom head 30 is to be inserted between the connecting plate 65A and the connecting plate 64B, and the connecting plate 34B of the connecting portion 34 is to be inserted between the connecting plate 65B and the connecting plate 65C.

Engaging portions 66 and 67 are provided on both ends in a lower wall portion 60B in the rear end of the jib support 60. The engaging portion 66 has three engaging plates 66A to 66C arranged at predetermined intervals. Recessed portions 66Aa to 66Ca opening upward are formed in the engaging plates 66A to 66C, respectively. One of the shaft pins P1 described later is to engage with the recessed portions 66Aa to 66Ca.

The shaft holding plate 35A of the shaft holding portion 35 of the boom head 30 is to be inserted between the engaging plate 66A and the engaging plate 66B, and the shaft holding plate 35B of the shaft holding portion 35 of the boom head 30 is to be inserted between the engaging plate 66B and the engaging plate 66C.

Likewise, the engaging portion 67 has three engaging plates 67A to 67C arranged at predetermined intervals. Recessed portions 67Aa to 67Ca opening upward are formed in the engaging plates 67A to 67C, respectively. The other one of the shaft pins P described later is to engage with the recessed portions 67Aa to 67Ca.

The shaft holding plate 36A of the shaft holding portion 36 of the boom head 30 is to be inserted between the engaging plate 67A and the engaging plate 67B, and the shaft holding plate 36B of the shaft holding portion 36 is to be inserted between the engaging plate 67B and the engaging plate 67C.

As shown in FIGS. 7 and 10, hooks 68 and 69 are provided outside the engaging portions 66 and 67 rotatably around shafts 68J and 69J. When the shaft pins P1 engage with the recessed portions 66Aa to 66Ca and 67Aa to 67Ca of the engaging plates 66A to 66C and 67A to 67C, the hooks 68 and 69 are rotated around the shafts 68J and 69J. Thus, the recessed portions 68*a* and 69*a* of the hooks 68 and 69 are engaged with the shaft pins P1 to prevent detachment of the shaft pins P1 from the recessed portions 66Aa to 66Ca and 67Aa to 67Ca of the engaging plates 66A to 66C and 67A to 67C.

The attachment/detachment mechanism of the jib 50 is constituted by the connecting portions 33 and 34 and the shaft holding portions 35 and 36 of the boom head 30, and the connecting portions 64 and 65 and the engaging portions 66 and 67 of the jib support 60.

[Guide Roller]

Figure 11:
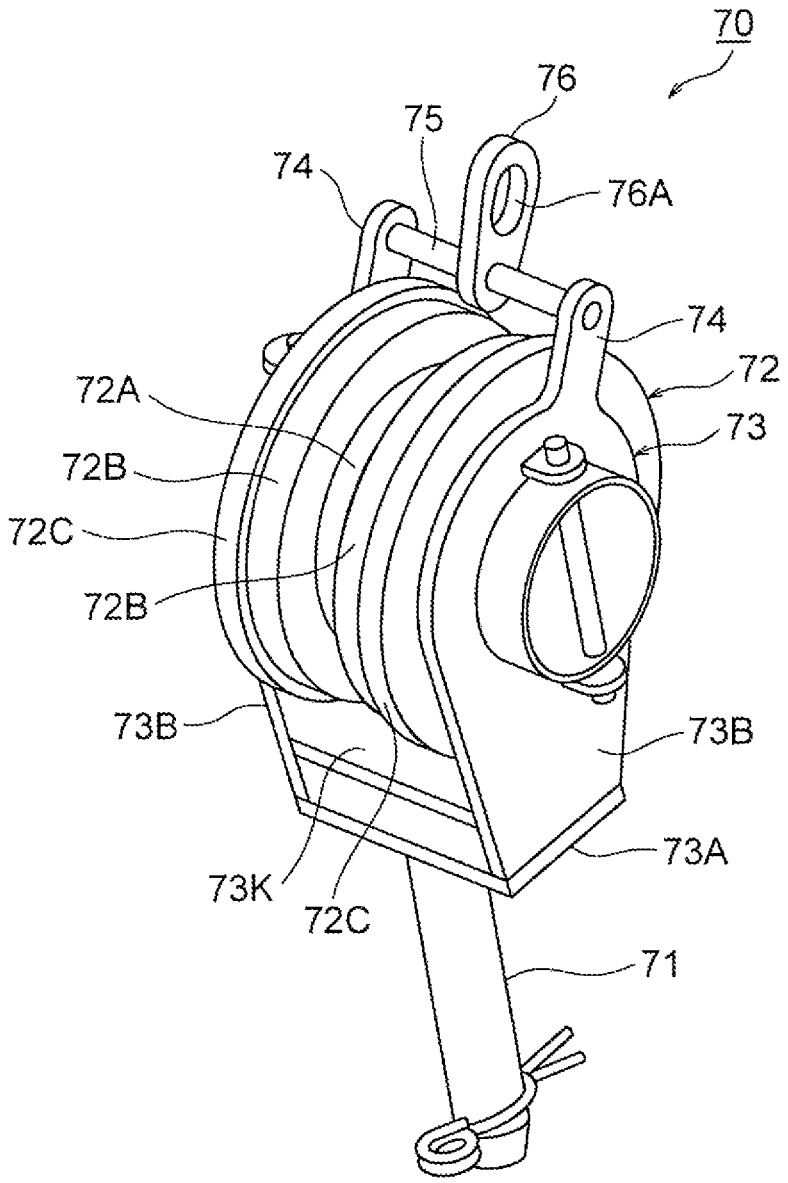
FIG. 11 is a perspective view showing the guide roller.
Figure 12:
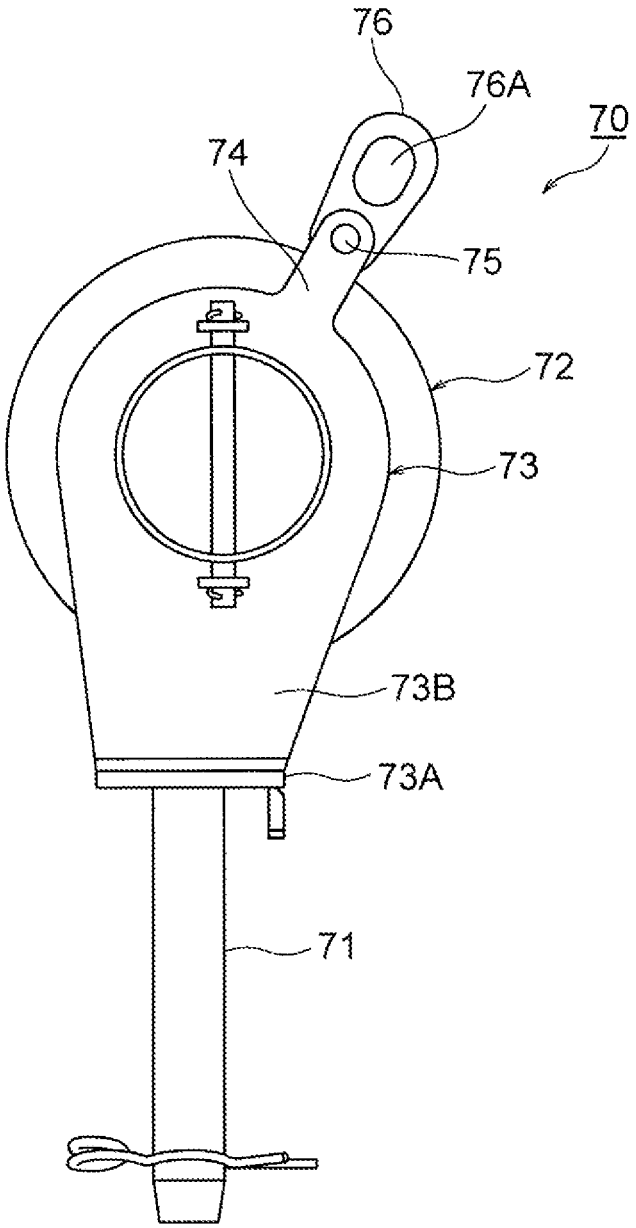
FIG. 12 is a side view of the guide roller shown in FIG. 11.
Figure 13:
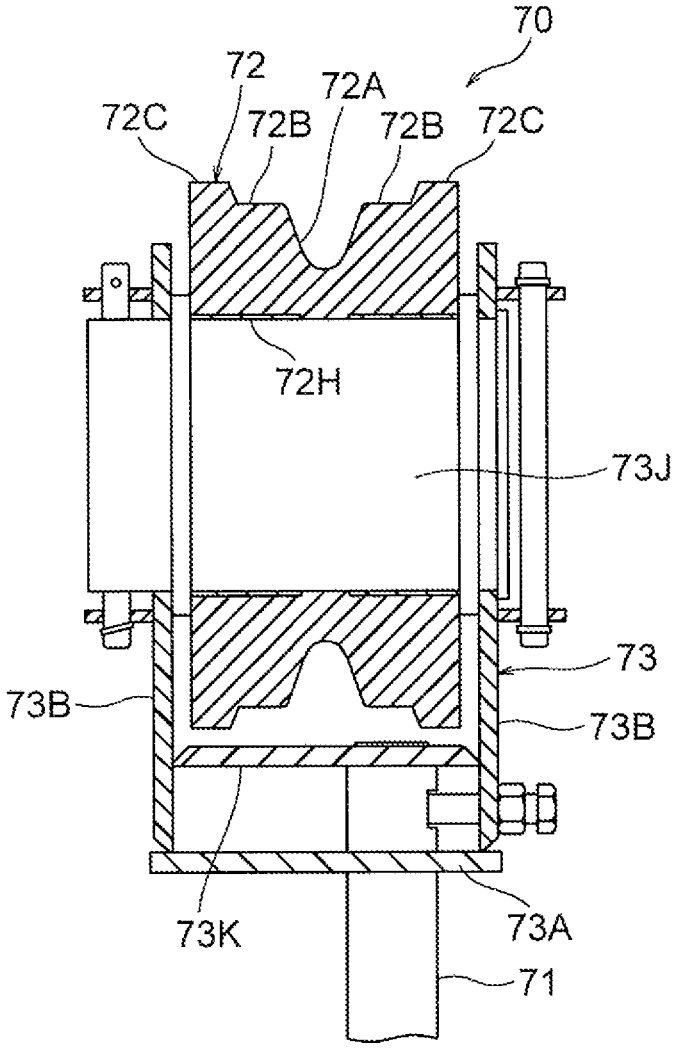
FIG. 13 is a cross-sectional view showing a structure of the guide roller shown in FIG. 12.

As shown in FIGS. 11 to 13, the guide roller 70 has a guide roller main body 72, a holding frame 73 rotatably holding the guide roller main body 72, the supporting rod 71 provided to a bottom plate 73A of the holding frame 73, and the like.

[Guide Roller Main Body]

The guide roller main body 72 has a circular guide groove (circular groove) 72A formed in a center portion of a circumferential surface along a circumferential direction, circumferential surface portions 72B and 72B formed on both sides of the guide groove 72A along the circumferential direction and each having a predetermined width, and step portions 72C and 72C formed outside the circumferential surface portions 72B and 72B to be higher than the circumferential surface portions 72B and 72B by a step.

In addition, a shaft hole 72H extending in a direction of an axis of the circumferential surface portions 72B is formed in the guide roller main body 72.

[Holding Frame]

The holding frame 73 has a shaft portion 73J inserted in the shaft hole 72H of the guide roller main body 72, side plate portions 73B and 73B holding both end portions of the shaft portion 73J, the bottom plate 73A connecting the side plate portions 73B and 73B to each other, and a reinforcing plate 73K arranged above the bottom plate 73A.

An upper portion of the supporting rod 71 is fixed to the reinforcing plate 73K. The supporting rod 71 penetrates the bottom plate 73A, and is fixed to the reinforcing plate 73K and the bottom plate 73A. Thus, the guide roller main body 72 is in a state of being supported by the holding frame 73 which is, in turn, supported by the supporting rod 71.

In addition, the guide roller main body 72 is rotatable around the shaft portion 73J.

Protruding portions 74 and 74 are formed in upper portions of the side plate portions 73B and 73B. A rod 75 is set between the protruding portions 74 and 74. A connection member 76 having a hole 76A to which a wire is tied is provided to the rod 75.

[Guide Support]

Figure 14A:
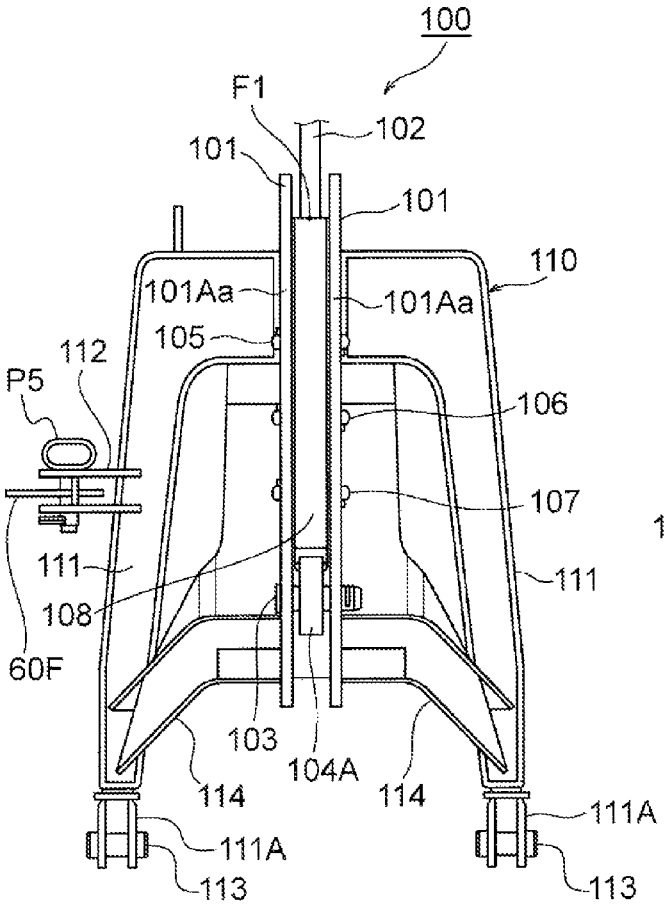
FIG. 14A is a back view of a guide support.
Figure 14B:
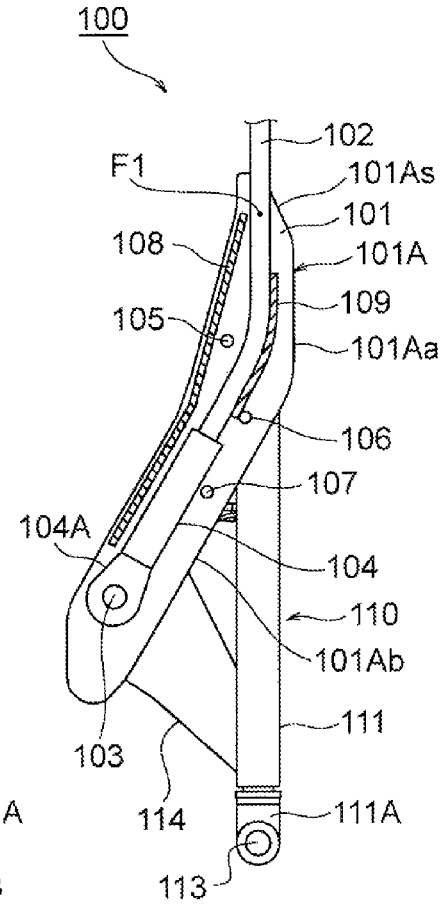
FIG. 14B is a vertical cross-sectional view of the guide support.

As shown in FIGS. 14A and 14B, the guide support 100 has a pair of guide walls (guide members) 101 and 101 facing each other at a predetermined interval, a holding member 110 holding the guide walls 101 and 101, and a wire 102 arranged between the guide walls 101 and 101.

[Guide Walls]

A right (in FIG. 14B) end surface 101A of one of the guide walls 101 serves as a guide surface, and an upper portion of the end surface 101A is formed to extend vertically and serves as a vertical guide surface 101Aa. A portion above the vertical guide surface 101Aa is formed as an upper guide surface 101As inclined obliquely upward. In addition, a portion below the vertical guide surface 101Aa is formed as an inclined guide surface 101Ab inclined obliquely frontward (to the left in FIG. 14B). The structure of the other guide wall 101 is the same, and description thereof is omitted.

A connection shaft 103 is fixed to lower portions of the guide walls 101 and 101, and a lower portion 104A of a cable end fitting 104 is rotatably attached to the connection shaft 103. An end portion of the wire 102 is inserted into the cable end fitting 104, and the end portion is fixed inside the cable end fitting 104.

The guide walls 101 and 101 are connected by multiple pins 105 to 107. As shown in FIG. 14B, a cover wall 108 is arranged on a left side and a cover wall 109 is arranged on a right side between the guide walls 101 and 101.

The cable end fitting 104 is made almost parallel with the inclined guide surfaces 101Ab of the guide walls 101 by the cover wall 108 and the pin 107. In addition, the cover wall 109, the pin 105, and an upper portion of the cover wall 108 are configured to guide the wire 102 upward.

The cover wall 108 is set so that the wire 102 and leg members 111 described later can be aligned on a straight line when the wire 102 is pulled upward, as shown in FIG. 14B.

[Holding Member]

The holding member 110 has a pair of the leg members 111 and 111 extending downward, and upper portions of the guide walls 101 and 101 are fixed to upper portions of the leg members 111 and 111. As shown in FIGS. 7, 9, and 10, lower end portions 111A and 111A of the leg members 111 and 111 are fixed by shaft members 113 and 113 to supporting plates 60S and 60S provided to a lower wall portion 60B of the jib support 60. The leg members 111 are symmetrical with respect to the guide walls 101 and 101.

Lower portions of the leg members 111 and 111 and lower portions of the guide walls 101 and 101 are connected and fixed to each other by connecting members 114 and 114.

The positions of the shaft members 113 and 113 are set near the axis of the shaft pins P1 and P1 being in a state of engaging with the recessed portions 66Aa to 66Ca and 67Aa to 67Ca (see FIG. 10) of the engaging plates 66A to 66C and 67A to 67C.

In addition, one (on the right side in FIGS. 9 and 10) of the leg members 111 is connected by connecting a connection member 112 provided to the leg member 111 and a connection member 60F provided on a supporting-column wall portion 60C in the rear end of the jib support 60 by a pin P5. By the connecting and the like, the guide support 100 is fixed to the rear end of the jib support 60, as shown in FIGS. 7 to 10.

[Mounting of Jib]

Next, a method for mounting the jib 50 configured as described above onto the boom head 30 is described.

Figure 15:
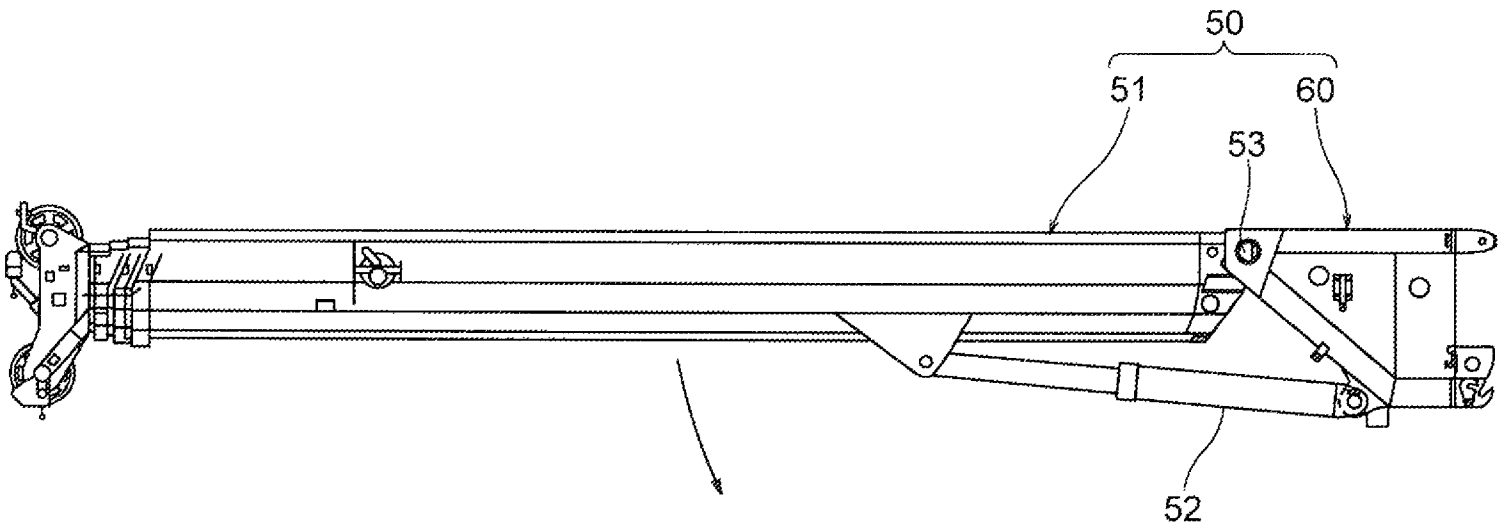
FIG. 15 is an explanatory view showing a structure of the jib.

First, as shown in FIG. 15, the jib 50 is laid on the ground with the cylinder 52 of the jib 50 being extended to maximize an angle of the jib main body 51 luffed with respect to the jib support 60. Note that, as shown in FIG. 7, the supporting rod 71 of the guide roller 70 is inserted into the bearing portion 62 of the jib support 60 to hold the guide roller 70 by the bearing portion 62.

Figure 16:
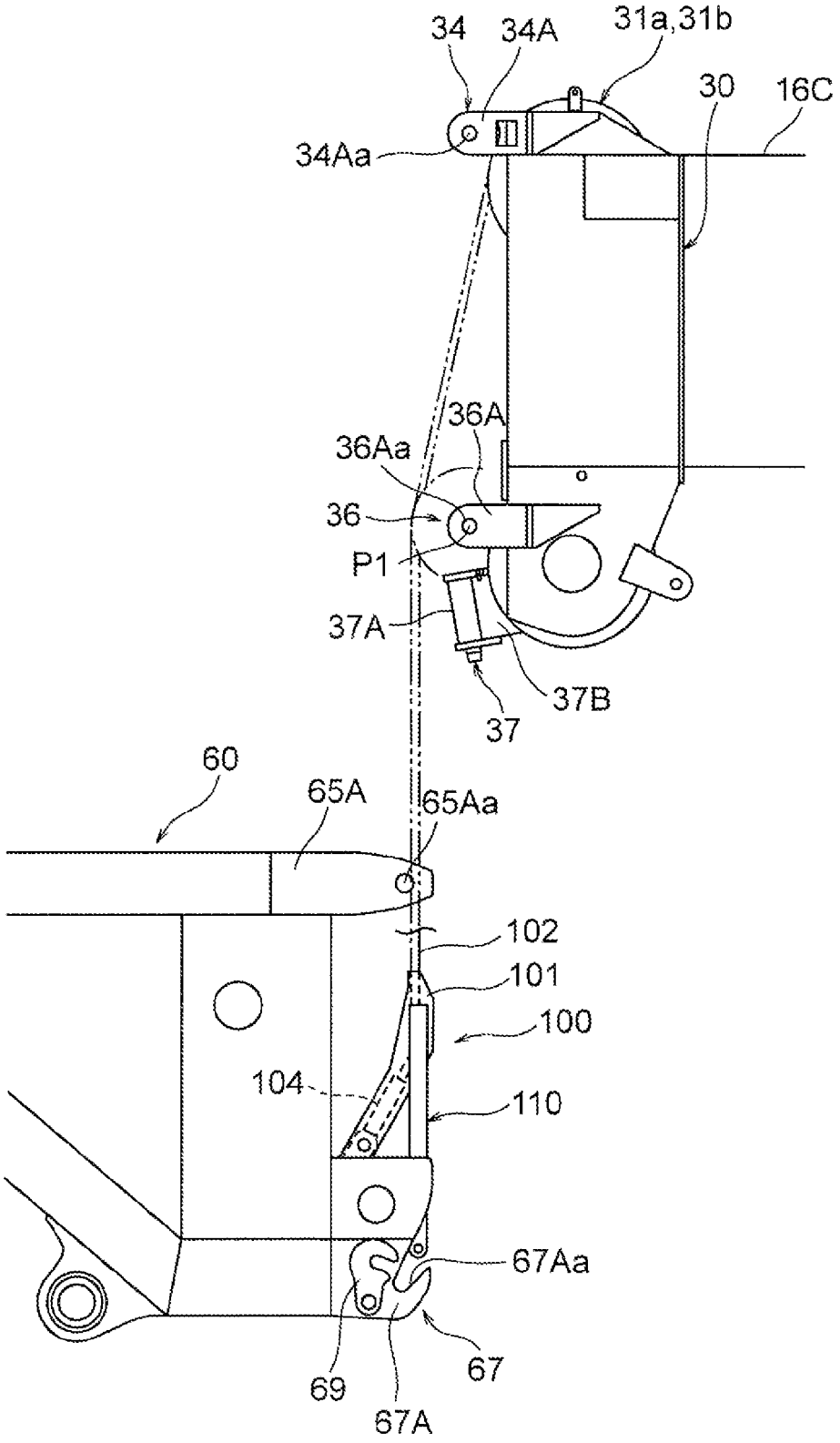
FIG. 16 is an explanatory view showing a positional relationship between the jib support and the boom head at the time of mounting of the jib onto the boom head.

Next, while the telescopic boom 16 of the crane 10 is kept in a folded state, the crane 10 is moved so that the boom head 30 of the telescopic boom 16 can be positioned near an area above the jib support 60, as shown in FIG. 16. In addition, the shaft pins P1 (illustrated in only FIG. 16) are inserted into the pin insertion holes 35Aa, 35Ba, 36Aa, and 36Ba of the shaft holding plates 35A, 35B, 36A, and 36B (see FIG. 4) of the boom head 30.

A tip portion of a wire (not illustrated) is tied to the connection member 76 of the guide roller 70, and the wire is pulled up by a winch (not illustrated) of the crane 10. Thus, the guide roller 70 is detached from the bearing portion 62 of the jib support 60 shown in FIG. 7.

The guide roller 70 detached from the bearing portion 62 is pulled up by the wire, and the supporting rod 71 of the guide roller 70 is inserted into the tubular portion 37A of the boom head 30 shown in FIG. 16. The supporting rod 71 is inserted into the tubular portion 37A by letting the wire out by the winch to move the guide roller 70 downward.

Figure 17:
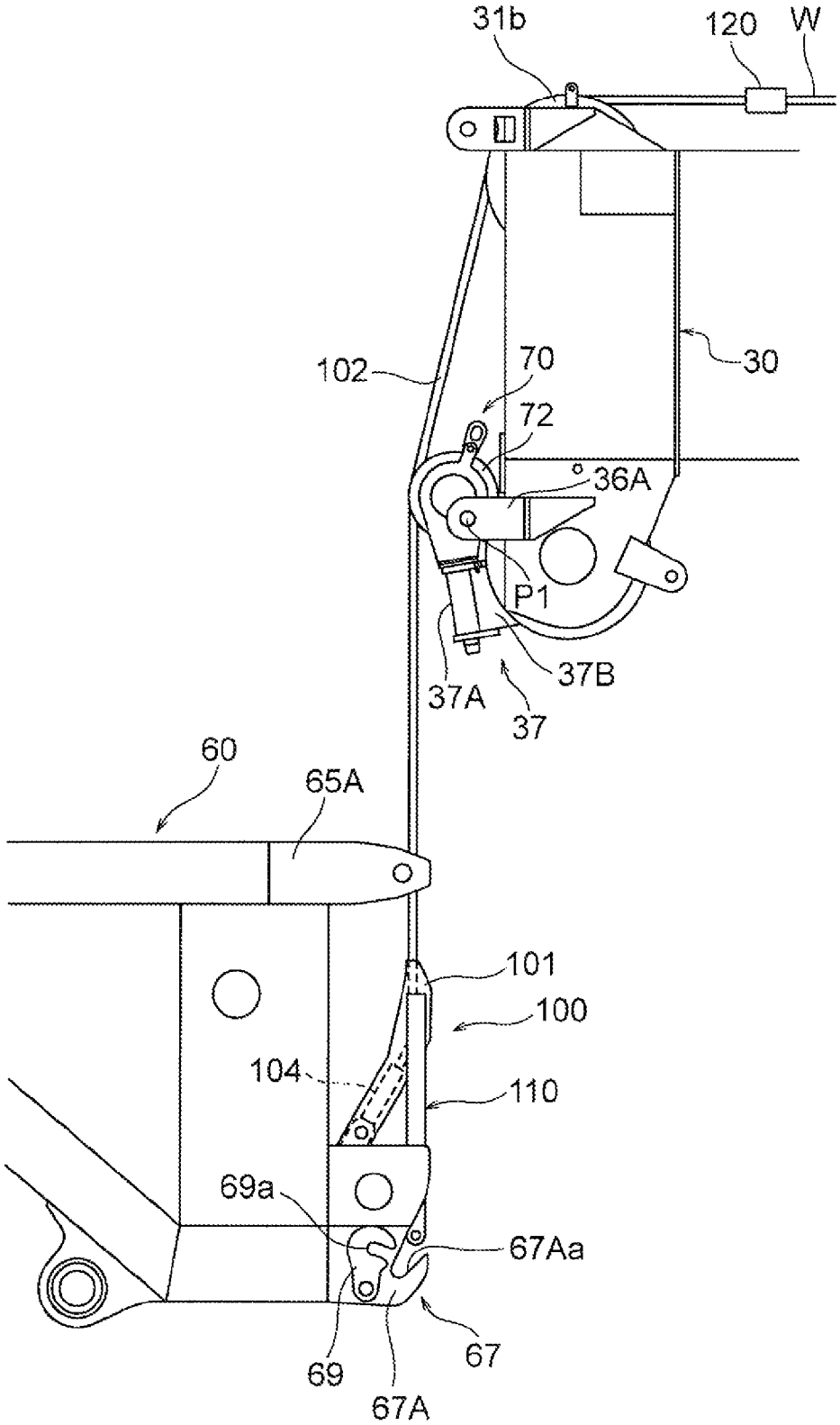
FIG. 17 is an explanatory view showing a case where the jib support is mounted onto the boom head by being pulled up with a wire.

By inserting the supporting rod 71 of the guide roller 70 into the tubular portion 37A of the boom head 30, the guide roller 70 is held by the tubular portion 37A of the boom head 30 as shown in FIG. 17.

Since the tubular portion 37A is provided to a lower portion of the boom head 30, the guide roller 30 is mounted at a low position. Hence, the mounting operation is safe. In addition, the guide roller 30 is pulled up from the bearing portion 62 of the jib support 60 by the wire of the crane. Hence, it is unnecessary to provide a winch dedicated to the guide roller 30.

After that, the wire tied to the connection member 76 of the guide roller 70 is detached, and the wire is rewound until a tip portion Wa of the wire W (see FIG. 17) reaches an upper surface of the tip boom 16C.

Next, the wire 102 of the guide support 100 is inserted into the guide groove 72A (see FIG. 11) of the guide roller main body 72 of the guide roller 70 shown in FIG. 17, and further set on the sheave 31*b* (see FIG. 2) of the boom head 30. Then, a rear end portion of the wire 102 and a tip portion of the wire W are connected to each other by a joint member 120 as shown in FIG. 17.

Then, by winding up the wire W with the winch, the wire 102 is pulled up. With the pulling-up of the wire 102, the jib support 60 is pulled up together with the rear portion of the jib main body 51. Here, since the wire 102 is inserted into the guide groove 72A of the guide roller main body 72, shift of the jib support 60 in a left-right direction (a width direction of the telescopic boom 16) with respect to the boom head 30 is corrected, and the jib support 60 is moved to a predetermined position in the left-right direction of the boom head 30.

Figure 18:
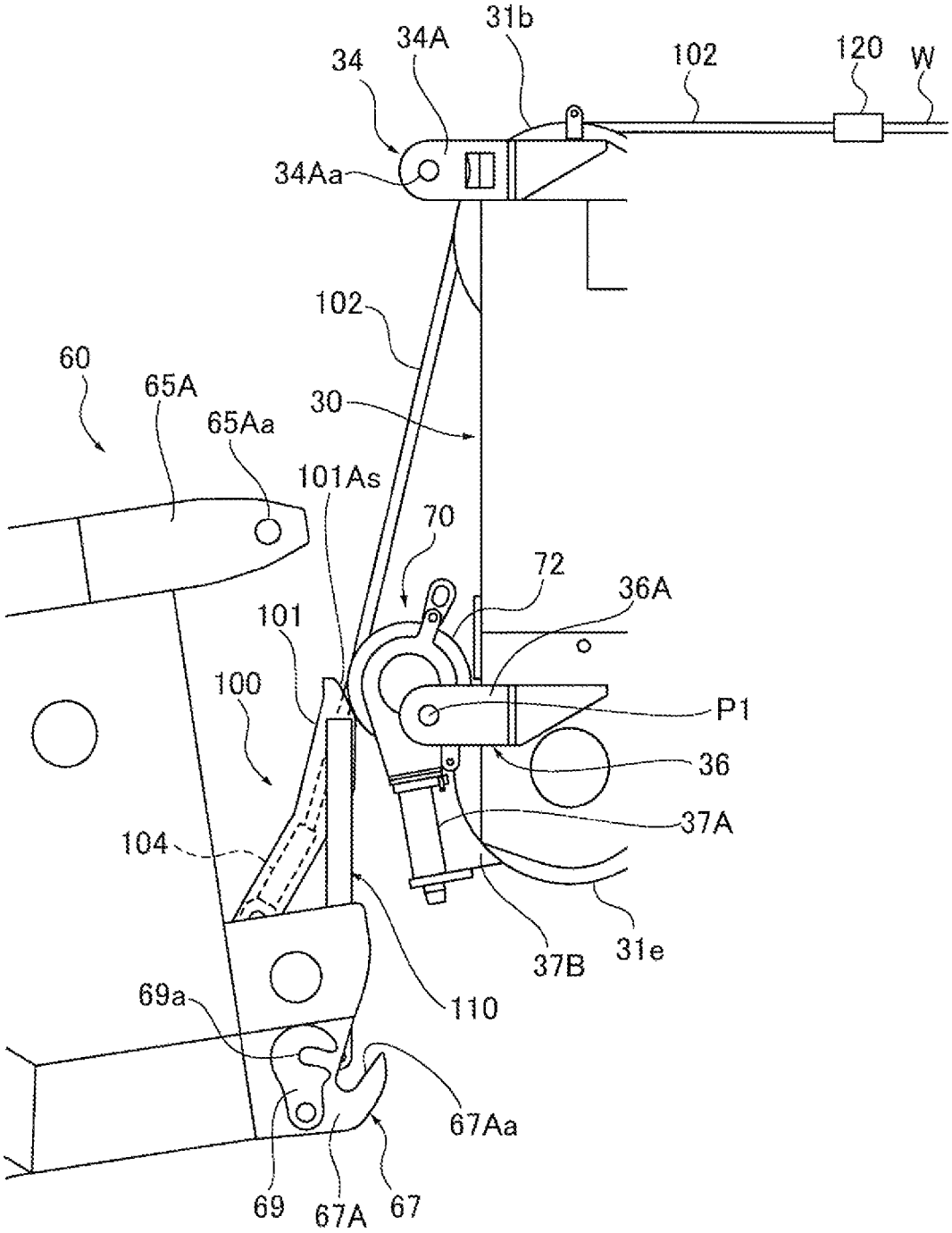
FIG. 18 is an explanatory view showing a state where the jib support is pulled up to a position of the guide roller.
Figure 19:
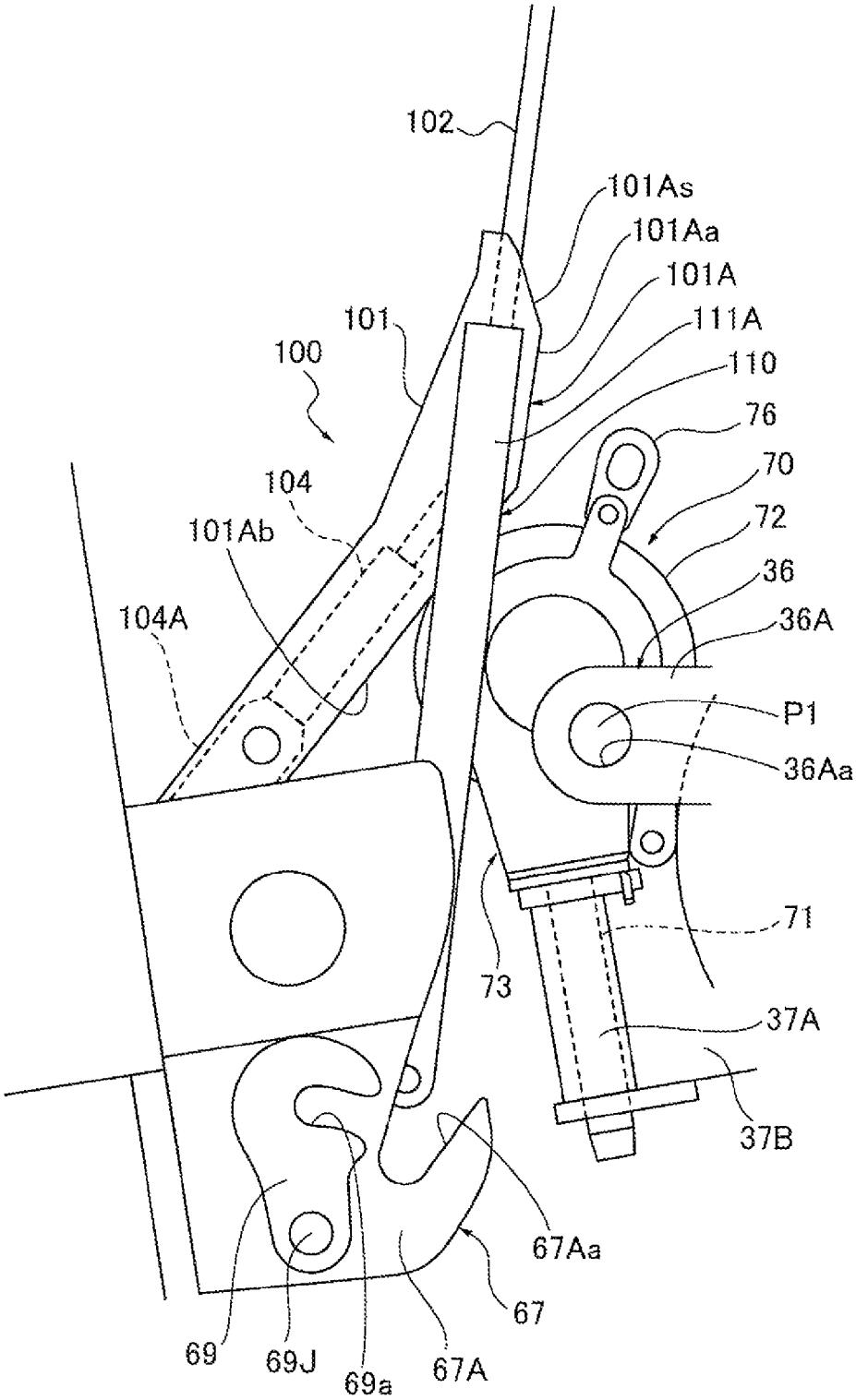
FIG. 19 is an explanatory view showing a state where the guide roller is being guided by the guide support.

When the jib support 60 is pulled up to a predetermined height, as shown in FIG. 18, the upper guide surfaces 101As and 101As of the guide walls 101 and 101 of the guide support 100 come into contact with the circumferential surface portions 72B and 72B (see FIG. 11) of the guide roller main body 72. Moreover, as the wire 102 is pulled up, the vertical guide surfaces 101Aa and 101Aa of the guide walls 101 and 101 come into contact with the circumferential surface portions 72B and 72B of the guide roller main body 72. After that, as shown in FIG. 19, the inclined guide surfaces 101Ab and 101Ab of the guide walls 101 and 101 come into contact with the circumferential surface portions 72B and 72B of the guide roller main body 72.

The upper guide surfaces 101As and 101As, the vertical guide surfaces 101Aa and 101Aa, and the inclined guide surfaces 101Ab and 101Ab of the guide walls 101 and 101 are reliably brought into contact with the circumferential surface portions 72B and 72B of the guide roller main body 72, because the wire 102 is inserted into the guide groove 72A of the guide roller main body 72, and guided by the guide groove 72A.

Figure 20:
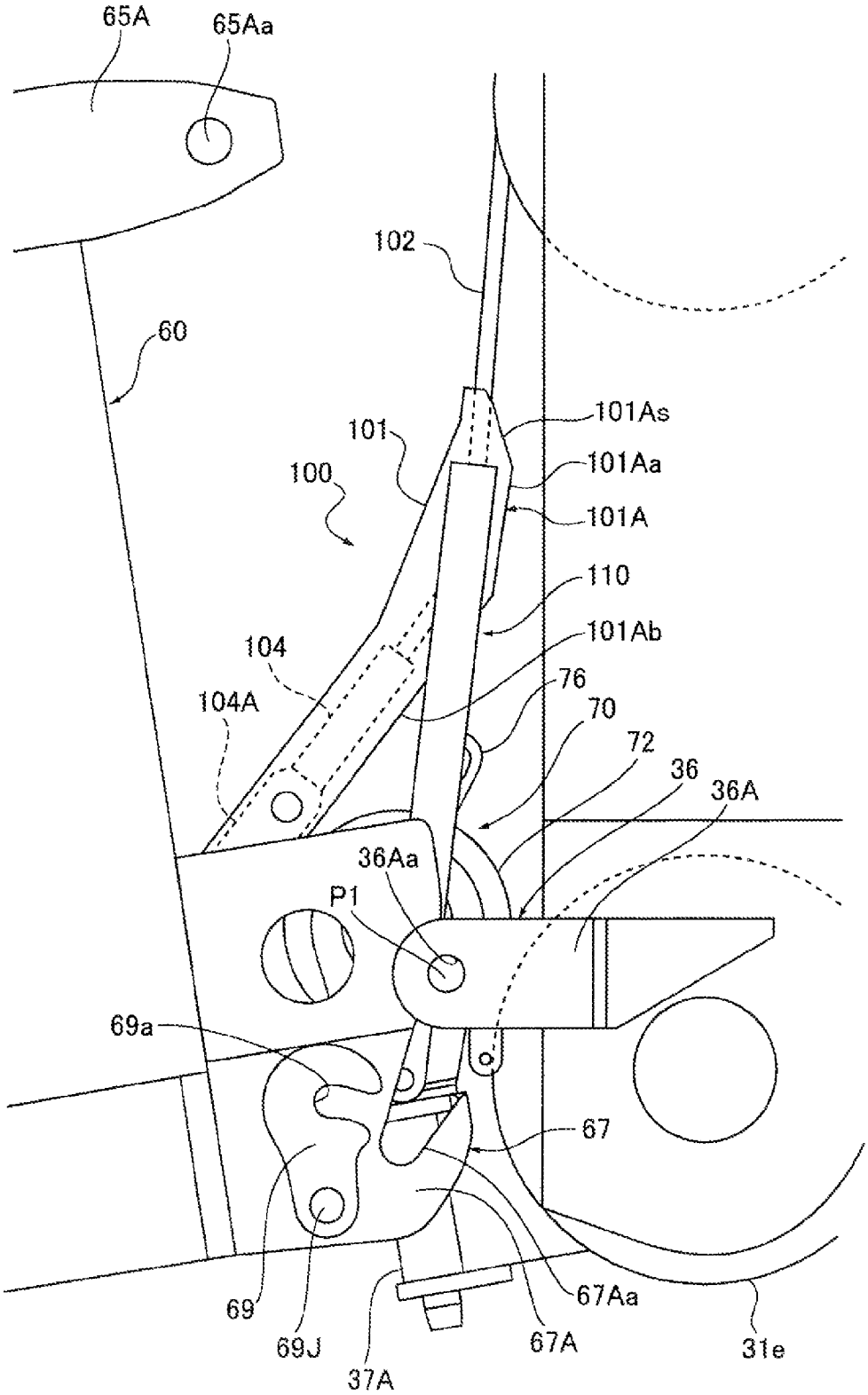
FIG. 20 is an explanatory view showing a state where the guide roller comes to a position of a lower portion of a guide wall of the guide support.
Figure 21:
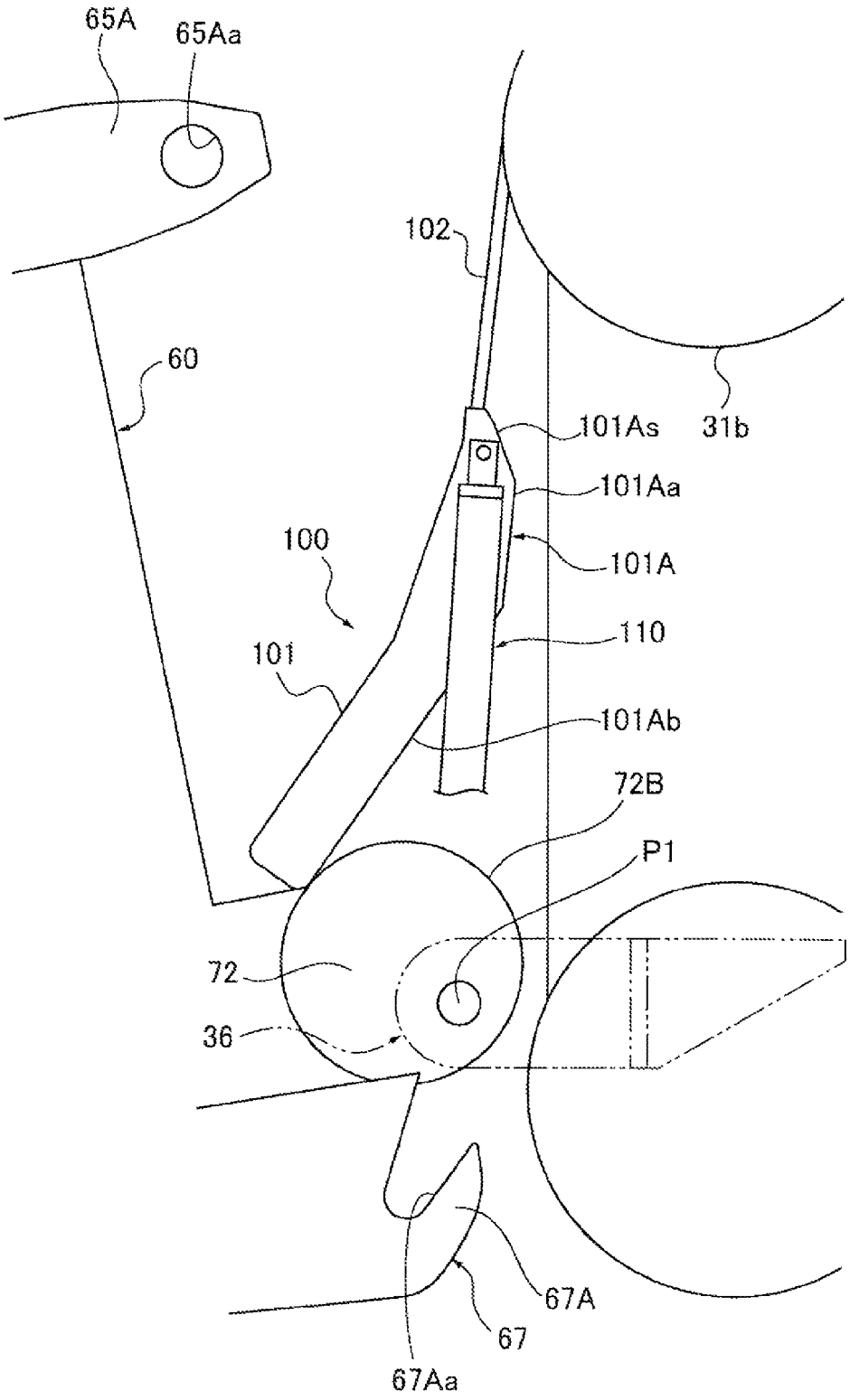
FIG. 21 is an explanatory view showing a positional relationship between a shaft pin and a recessed portion immediately before separation of the guide roller from the guide wall.

In addition, since the inclined guide surfaces 101Ab and 101Ab of the guide walls 101 and 101 come into contact with the circumferential surface portions 72B and 72B of the guide roller main body 72, the jib support 60 is guided to a predetermined position shown in FIGS. 20 and 21.

Specifically, as shown in FIG. 21, at a position where the circumferential surface portions 72B and 72B of the guide roller main body 72 are in contact with lower portions of the inclined guide surfaces 101Ab and 101Ab of the guide walls 101 and 101, the recessed portions 66Aa to 66Ca and 67Aa to 67Ca (see FIG. 7) of the engaging plates 66A to 66C and 67A to 67C of the jib support 60 are positioned below the shaft pins P1 and P1 inserted into the pin insertion holes 35Aa, 35Ba, 36Aa, and 36Ba (see FIG. 4) of the shaft holding plates 35A, 35B, 36A, and 36B of the boom head 30.

When the jib support 60 at this position is pulled up, the engaging portions 66 and 67 of the jib support 60 engage with the shaft pins P1 and P1 of the shaft holding portions 35 and 36 of the boom head 30.

In other words, the guide walls 101 and 101 of the guide support 100 are guided by the guide roller main body 72 of the guide roller 70, and thus the jib support 60 is guided to the above-described position.

Figure 22A:
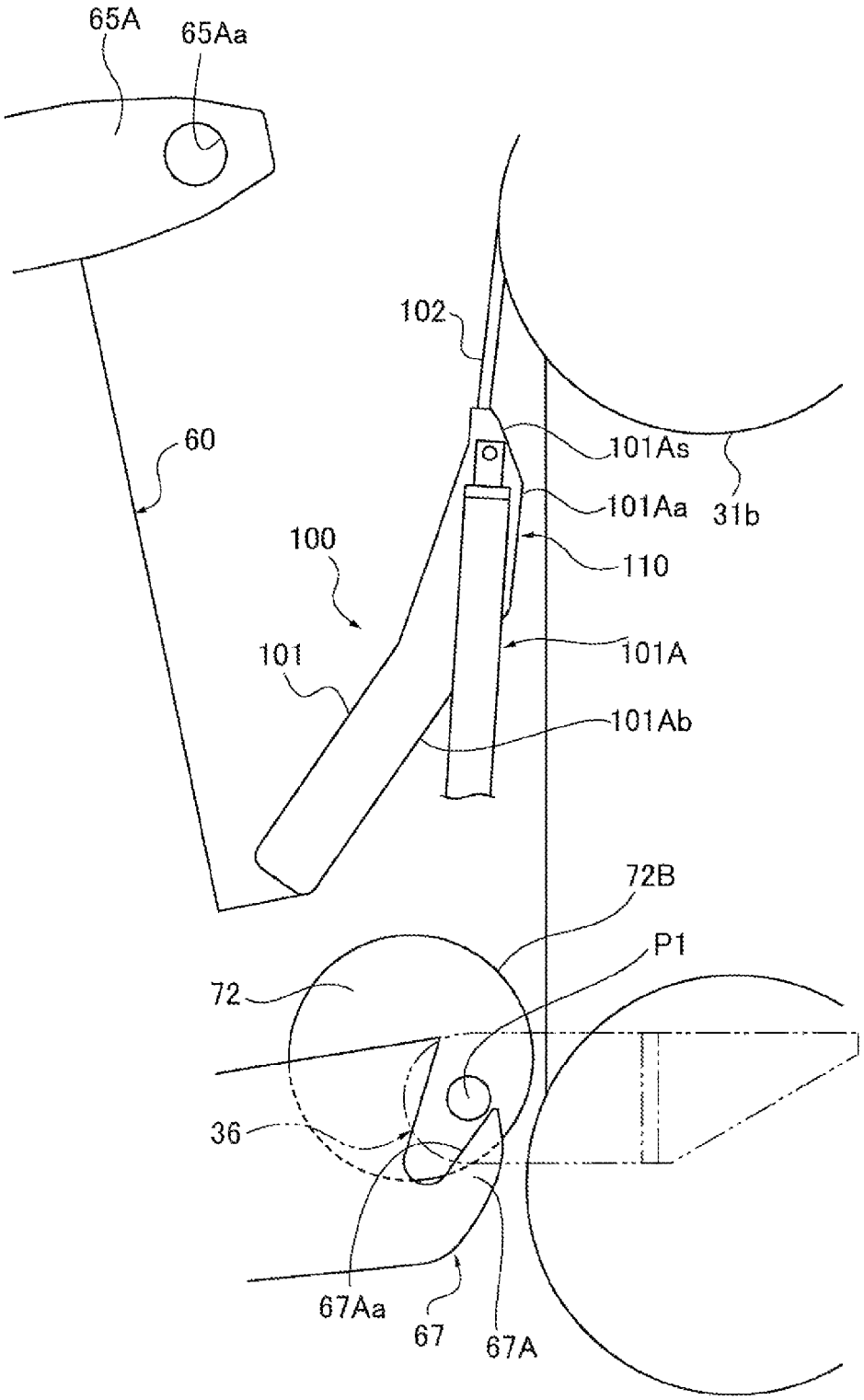
FIG. 22A is an explanatory view showing a positional relationship among members, where the shaft pin starts to be inserted into a recessed portion of an engaging portion.

As the jib support 60 in the state shown in FIG. 21 is further lifted up with the pulling-up by the wire 102, the shaft pin P1 is inserted into the recessed portion 67Aa of the engaging plate 67A, as shown in FIG. 22A.

Figure 22B:
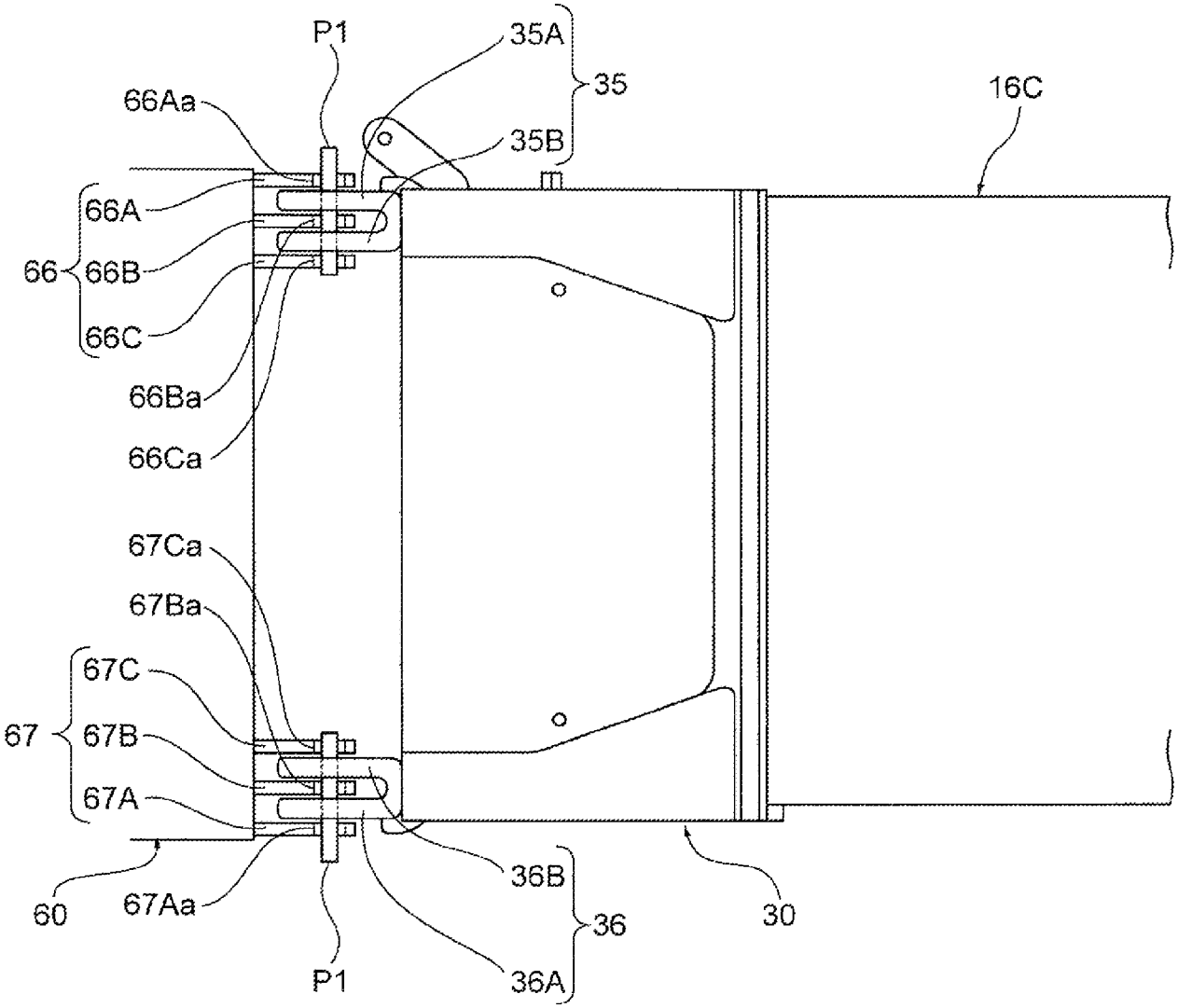
FIG. 22B is an explanatory view showing a state of engaging plates of engaging portions and shaft pins, where the shaft pins are inserted into recessed portions of the engaging portions.

In other words, as shown in FIG. 22B, the shaft pins P1 of the shaft holding portions 35 and 36 of the boom head 30 are inserted into the recessed portions 66Aa to 66Ca and 67Aa to 67Ca of the engaging plates 66A to 66C and 67A to 67C of the jib support 60.

Figure 23:
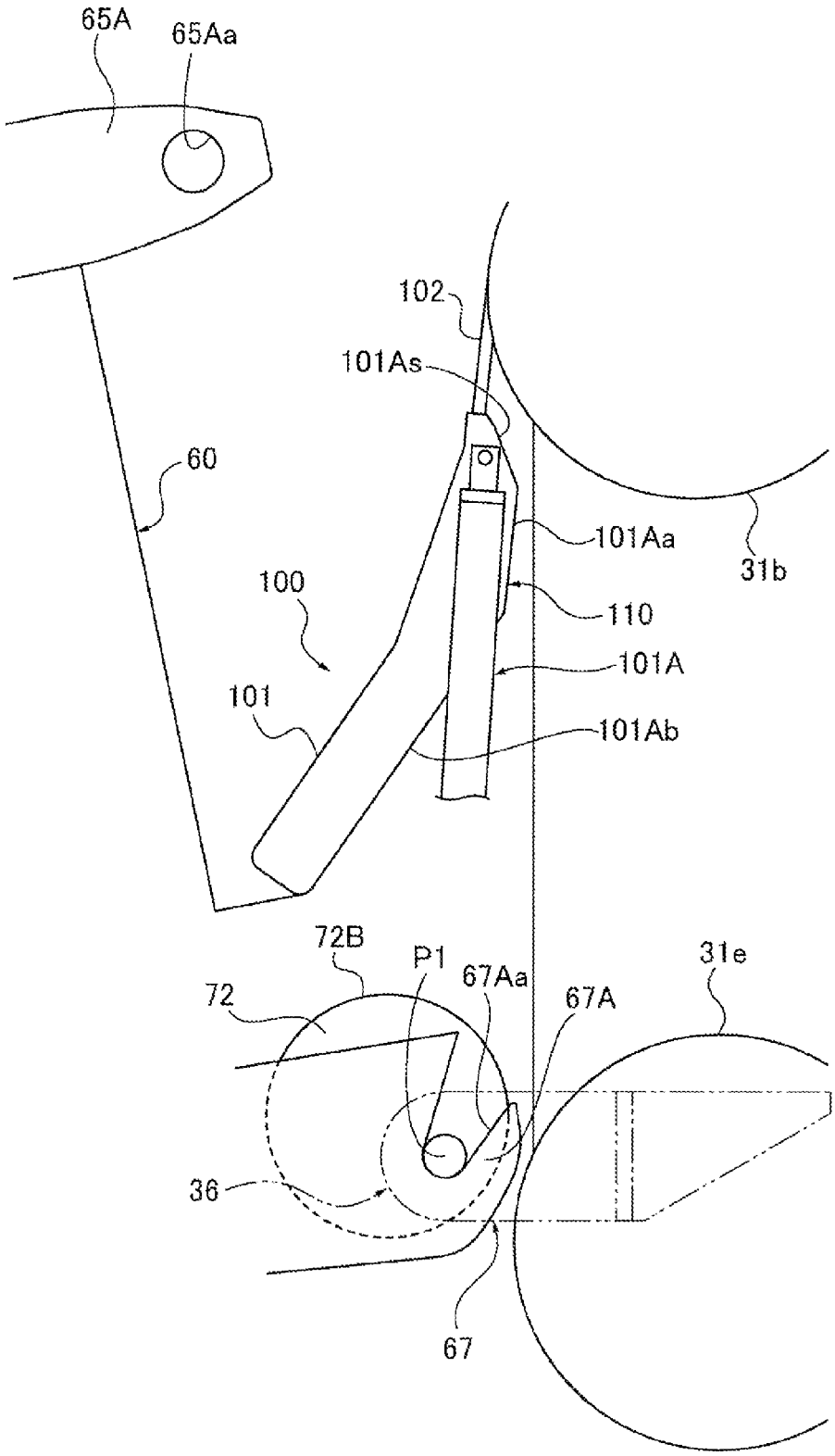
FIG. 23 is an explanatory view of a state where the insertion of the engaging portion of the shaft pin into the recessed portion is completed.

Then, by further pulling up the wire 102, the shaft pin P1 is engaged with the recessed portion 67Aa of the engaging plate 67A as shown in FIG. 23. In other words, the shaft pins P1 and P1 of the shaft holding portions 35 and 36 of the boom head 30 are engaged with the recessed portions 66Aa to 66Ca and 67Aa to 67Ca of the engaging plates 66A to 66C and 67A to 67C of the jib support 60.

As shown in FIG. 22B, this engagement is conducted as follows. Specifically, the shaft holding plate 35A of the shaft holding portion 35 of the boom head 30 is inserted between the engaging plate 66A and the engaging plate 66B of the engaging portion 66, and the shaft holding plate 35B of the shaft holding portion 35 of the boom head 30 is inserted between the engaging plate 66B and the engaging plate 66C. Likewise, the shaft holding plate 36A of the shaft holding portion 36 of the boom head 30 is inserted between the engaging plate 67A and the engaging plate 67B of the engaging portion 67, and the shaft holding plate 36B of the shaft holding portion 36 is inserted between the engaging plate 67B and the engaging plate 67C.

The insertion thereof can be conducted reliably because the wire 102 is inserted in the guide groove 72A of the guide roller main body 72, so that the shift of the jib support 60 in the right-left direction with respect to the boom head 30 is prevented.

Figure 24A:
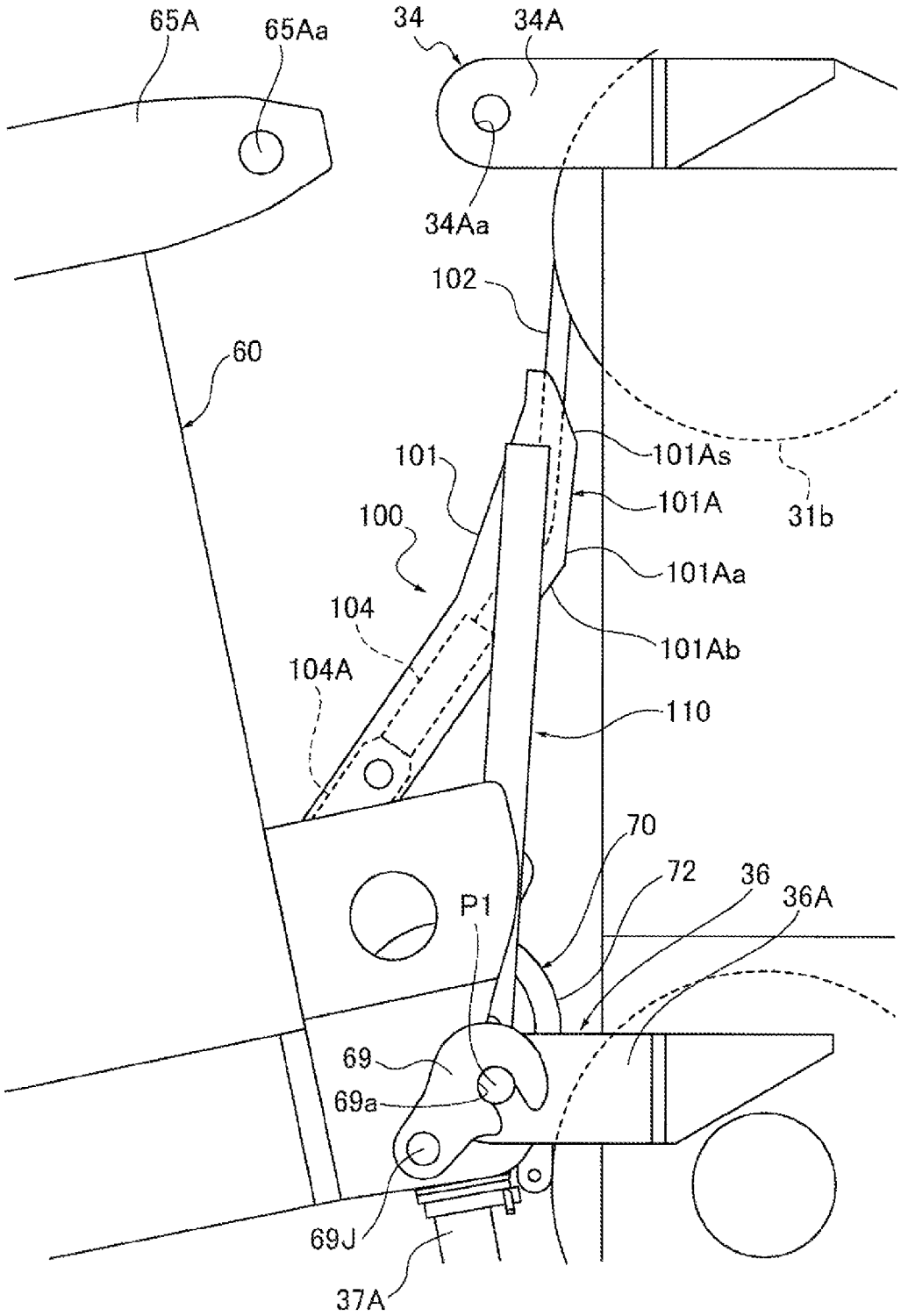
FIG. 24A is a side view showing a positional relationship among the guide roller, the guide support, and the like in a case where the insertion of the engaging portion of the shaft pin into the recessed portion is completed.

After the shaft pins P1 and P1 are engaged with the recessed portions 66Aa, 66Ba, 67Aa, and 67Ba (see FIG. 23) of the engaging plates 66A, 66B, 67A, and 67B, the operation of the winch is stopped. After that, as shown in FIG. 24A, the hook 69 is rotated to engage the recessed portion 69*a* of the hook 69 with the shaft pin P1. Likewise, the recessed portion 68*a* of the hook 68 (see FIG. 10) is engaged with the shaft pin P1.

Figure 24B:
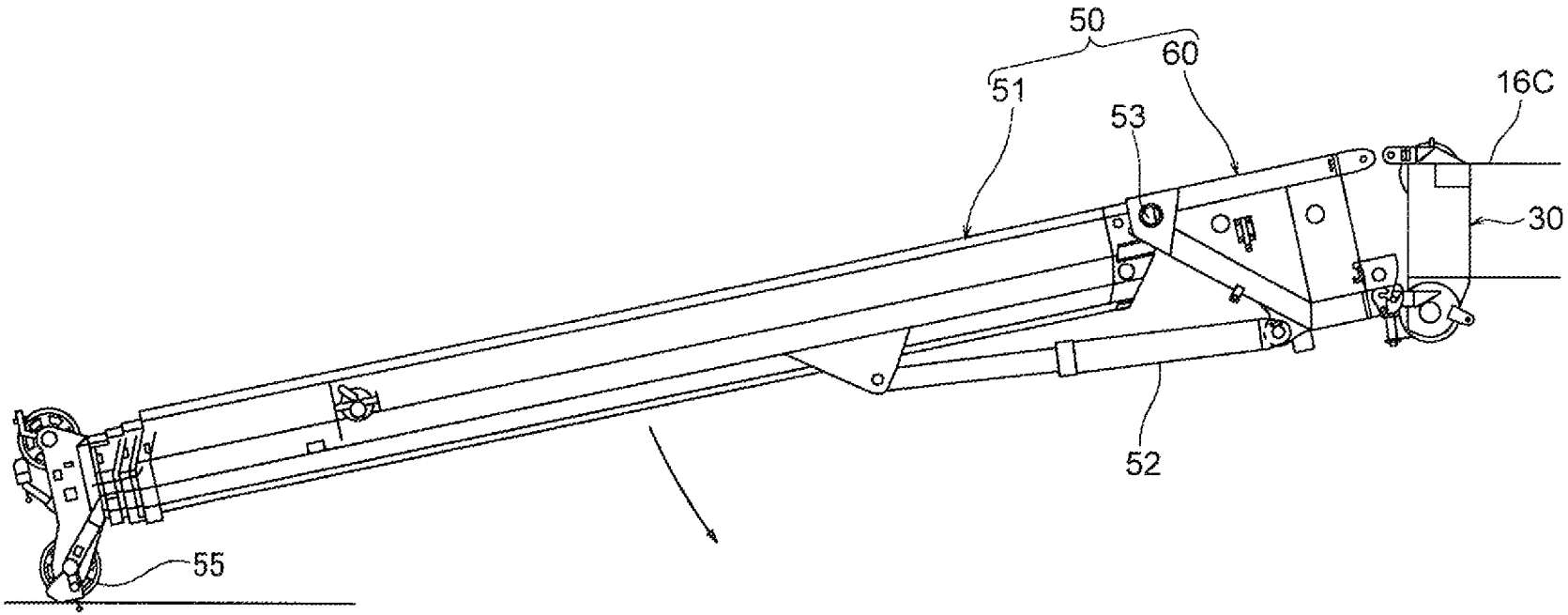
FIG. 24B is an explanatory view showing the jib and a jib head in the case where the insertion of the engaging portion of the shaft pin into the recessed portion is completed.

Next, as the cylinder 52 of the jib 50 is operated to contract, a force acts to rotate the jib main body 51 around the shaft 53 in a direction of the arrow, as shown in FIG. 24B. Since the sheave 55 in the tip portion of the jib main body 51 is in a state of being in contact with the ground, the shaft 53 comes up. Because of the coming-up of the shaft 53, the jib support 60 of the jib 50 rotates clockwise around the shaft pins P1 and P1, as shown in FIG. 25.

Figure 25:
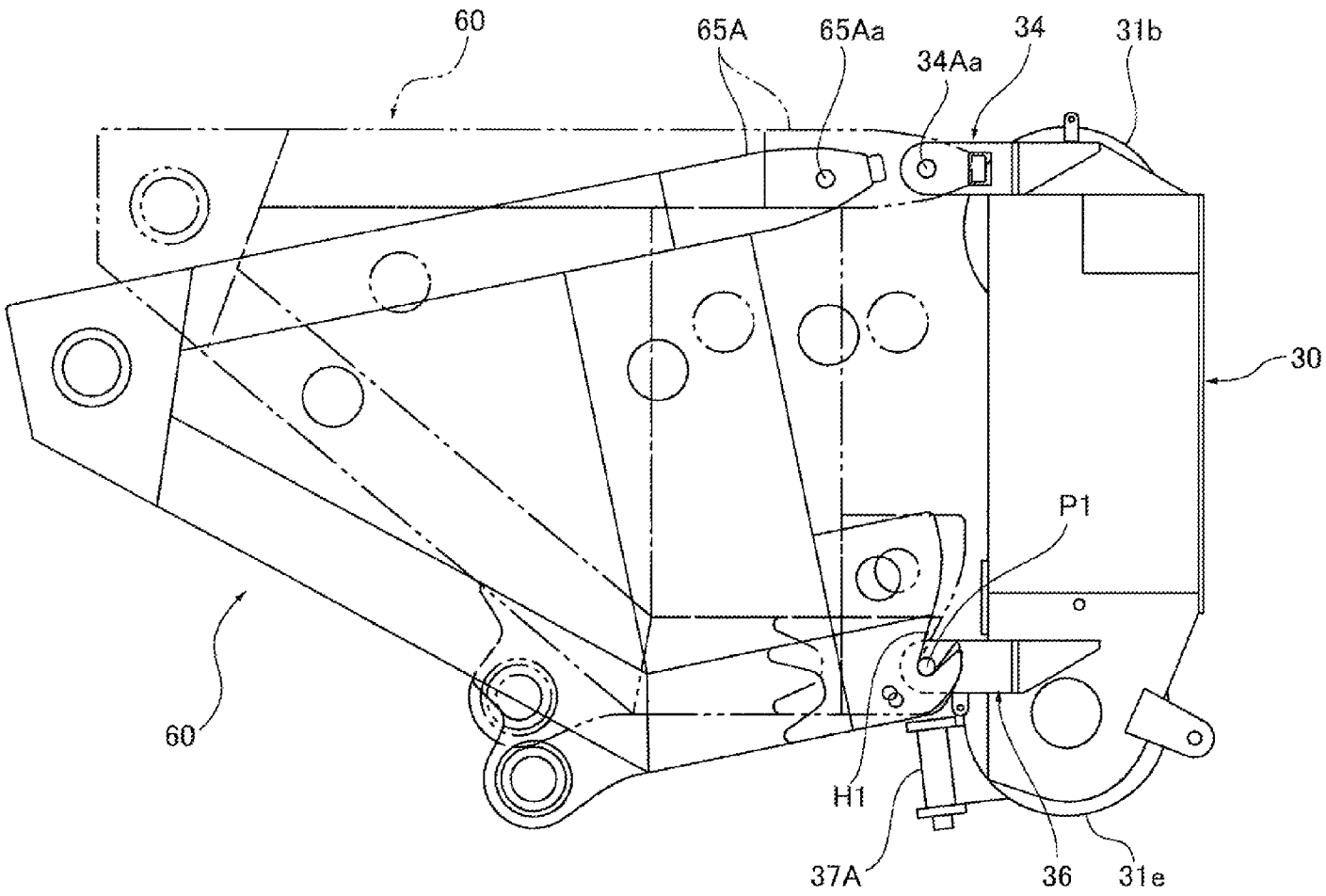
FIG. 25 is an explanatory view showing a state where the jib support is mounted on the boom head by being rotated around the shaft pin.
Figure 26:
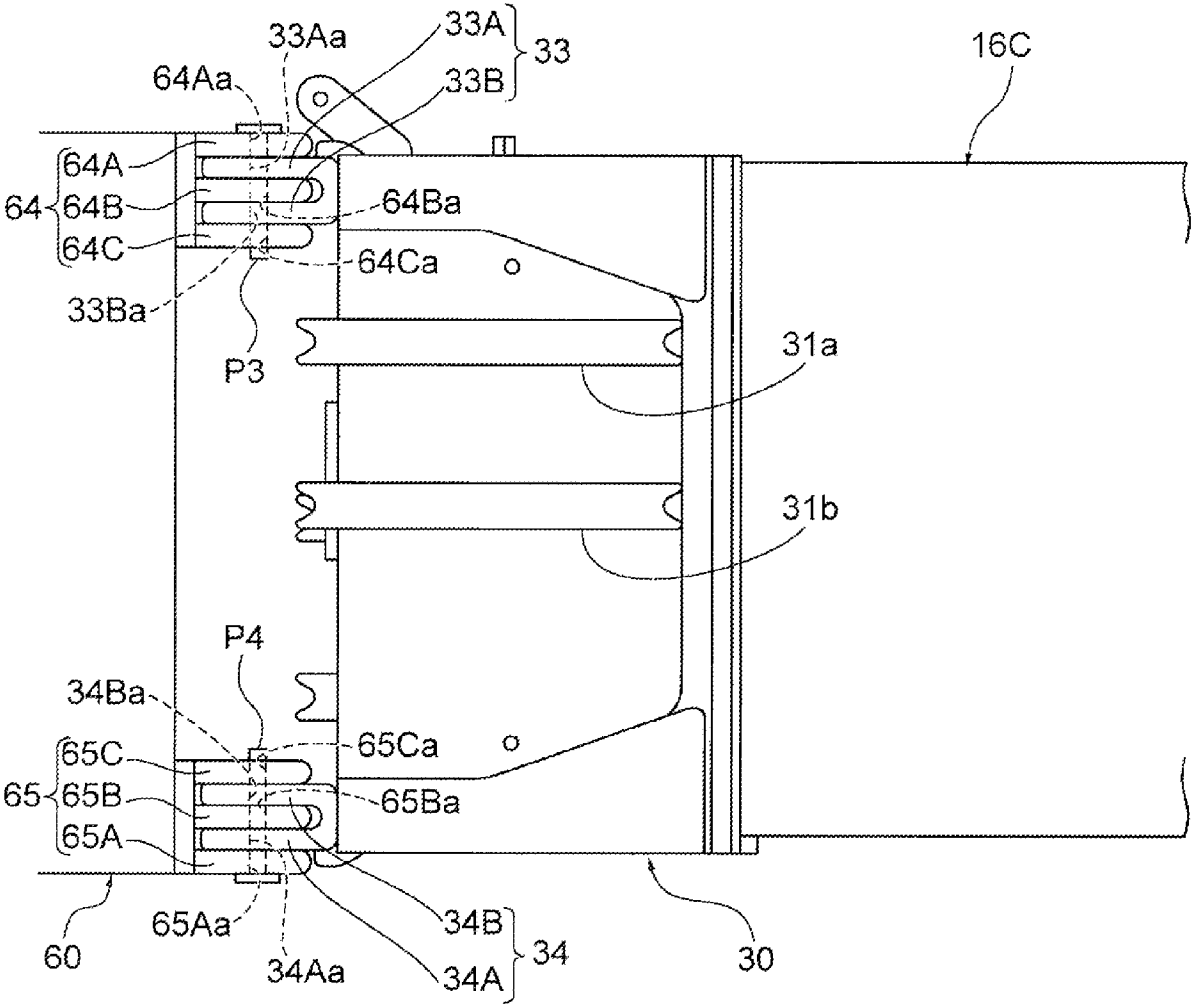
FIG. 26 is an explanatory view showing a state where connecting plates of connecting portions of the jib support are connected by pins to connecting plates of connecting portions of the boom head.

As the jib support 60 rotates to a position indicated by the dot and dash line shown in FIG. 25, the connecting plate 34A of the connecting portion 34 of the boom head 30 is inserted, as shown in FIG. 26, between the connecting plate 65A and the connecting plate 65B of the connecting portion 65 of the jib support 60, and the connecting plate 34B of the connecting portion 34 is inserted between the connecting plate 65B and the connecting plate 65C. Likewise, the connecting plate 33A of the connecting portion 33 of the boom head 30 is inserted between the connecting plate 64A and the connecting plate 64B of the connecting portion 64 of the jib support 60, and the connecting plate 33B of the connecting portion 33 is inserted between the connecting plate 64B and the connecting plate 64C.

After the insertion is completed, the operation of the winch is stopped. In addition, a pin P3 is inserted into the pin insertion holes 64Aa to 64Ca of the connecting plates 64A to 64C and the pin insertion holes 33Aa and 33Ba of the connecting plates 33A and 33B, and a pin P4 is inserted into the pin insertion holes 65Aa to 65Ca of the connecting plates 65A to 65C and the pin insertion holes 34Aa and 34Ba of the connecting plates 34A and 34B. Thus, the connecting plates 64A to 64C and 65A to 65C of the connecting portions 64 and 65 of the jib support 60 and the connecting plates 33A, 33B, 34A, and 34B of the connecting portions 33 and 34 of the boom head 30 are connected, so that the jib support 60 is mounted on the boom head 30. In other words, the jib 50 is mounted on the boom head 30.

Since detachment of the jib 50 from the boom head 30 can be achieved by conducting the above-described operations in a reversed manner, description of the detachment is omitted.

As described above, by the contraction operation of the cylinder 52 for luffing the jib main body 51, the connecting portions 64 and 65 of the jib support 60 can be moved to the connecting positions to the connecting portions 33 and 34 of the boom head 30. Hence, there is no need for a cylinder dedicated to the mounting of the jib support 60 on the boom head 30.

As shown in FIG. 25, with the contraction operation of the cylinder 52, the jib support 60 rotates clockwise around the shaft pins P1. Here, the position H1 of each of the shaft members 113 and 113 fixing the lower end portions 111A and 111A of the leg members 111 and 111 of the guide support 100 is set near the axis of the shaft pins P1. Hence, even when the jib support 60 is rotated from the position shown in FIG. 24A to the position indicated by the dot and dash line in FIG. 25, the positions H1 of the shaft members 113 and 113 hardly change. For this reason, this rotation does not change the tension of the wire 102, and the jib support 60 is prevented from falling down due to such a change in tension of the wire 102.

Since the positions H1 of the shaft members 113 and 113 do not change, the state of tension of the wire 102 does not change. For this reason, a problem which would otherwise occur because of an excessive force applied on the wire 102 by the contraction operation of the cylinder 52 is not caused.

In addition, when the jib support 60 is pulled up by the wire 102, the cover wall 108 aligns the wire 102 and the leg members 111 of the guide support 100 on the straight line, as shown in FIG. 14B. Hence, a portion above the leg members 111 and 111 is lifted up in this state. Accordingly, as shown in FIG. 14A, an isosceles triangle is formed by connecting the position F1 above the leg members 111 and 111 and points of the shaft members 113 and 113 of the lower end portions 111A and 111A of the leg members 111. Since the vertex (F1) of the isosceles triangle is lifted up in this state, the jib support 60 can be lifted up in a stable state.

The guide support 100 and the guide roller 70 are housed between the boom head 30 and the jib support 60 mounted on the boom head 30. Hence, the size of the crane 10 does not increase.

In the above-described embodiment, the shaft holding portions 35 and 36 (see FIG. 4), to which the shaft pins P1 are attached, are provided to the boom head 30, and the engaging portions 66 and 67 (see FIG. 7), which engage with the shaft pins P1, are provided to the jib support 60. However, those portions are interchangeable with each other. Moreover, the shaft members 113 and 113 of the lower end portions 111A and 111A of the leg members 111 are provided at the positions shifted from the positions of the axis of the shaft pins P1 and P1. Hence, when the shaft pins P1 and P1 are detached to detach the jib 50 from the boom head 30, the shaft members 113 and 113 do not interfere in the detachment of the shaft pins P1 and P1 in the axial direction.

In addition, the guide roller 70 is used in the above-described embodiment. However, the present invention is not limited to the guide roller 70, and, for example, a roller does not have to be used, as long as a member made of a material with low frictional resistance is used. In addition, the guide roller 70 is detachably held by the holding portion 37 (see FIG. 4) of the boom head 30. However, the guide roller 70 may be fixed to the holding portion 37.

In the above-described embodiment, the attachment/detachment mechanism for mounting the jib 50 on the boom head 30 of the telescopic boom 16 of the crane 10 is described. However, the present invention is not limited to this mechanism, and the mechanism may be an attachment/detachment mechanism for mounting a jib on a tip portion of a boom of a fixed operation machine.

The present invention is not limited to the above-described embodiment, and alteration, addition, and the like of the design are acceptable, unless the gist of the invention according to each claim in Scope of Claims is departed.

What is claimed is:

1. A jib attachment/detachment mechanism which includes a jib main body and a jib support rotatably provided to a rear portion of the jib main body and is configured to pull up a jib suspended by a wire to a boom head and detachably fix the jib to the boom head, the jib attachment/detachment mechanism comprising:

a first connecting portion provided to an upper portion of a tip of the boom head;

a second connecting portion provided to an upper portion of a rear end of the jib support, the second connection portion being detachably connected to the first connecting portion;

a locking portion provided to one of a lower portion of the tip of the boom head and a lower portion of the rear end of the jib support;

an engaging portion provided to the other of the lower portions and configured to engage with the locking portion; and a guide mechanism configured to guide the jib to a position where the locking portion or the engaging portion of the jib support is engaged with the engaging portion or the locking portion of the boom head and a position where the second connecting portion of the jib support is connected to the first connecting portion of the boom head, when the jib is pulled up by the wire, wherein the guide mechanism includes a guide unit provided on the rear end of the jib support and a guided member provided to the tip of the boom head and configured to be guided by the guide unit, the engaging portion or the locking portion of the jib support is engaged with the locking portion or the engaging portion of the boom head in such a way that the guided member is guided by the guide unit while the guide unit is pulled up and brought into contact with the guided member with the wire, the guided member is detachably attached to a side portion of the jib support, and when the guide unit is pulled up by the wire, the guided member is detached from the side portion of the jib support and detachably mounted on the tip of the boom head.

2. The jib attachment/detachment mechanism according to claim 1, wherein the guide unit has a guide member extending in a vertical direction and configured to guide the guided member, and a holding member that holds the guide member, the wire which is pulled up is fixed to a lower portion of the guide member, a lower portion of the holding member is fixed at a position near the engaging portion or the locking portion of the jib support, the guided member has a guide roller main body, a holding frame rotatably that holds the guide roller main body, and a supporting rod provided to the holding frame, the guide member includes a pair of guide walls facing each other with the wire arranged between the pair of guide walls, a circular groove is formed in a center portion of the guide roller main body to extend in a circumferential direction with the wire inserted in the circular groove and connected to the wire to be pulled up, the pair of guide walls guides the guide roller main body by coming into contact with circumferential surface portions of the guide roller main body on both sides of the circular groove, a first tubular portion is provided to a side portion of the jib support, the supporting rod of the holding frame being detachably inserted into the first tubular portion, and a second tubular portion is provided to the tip of the boom head, the supporting rod of the holding frame being detachably inserted into the second tubular portion.

3. The jib attachment/detachment mechanism according to claim 1, wherein when the jib is mounted on the boom head by connecting the second connecting portion to the first connecting portion, the guide unit and the guided member are housed between the boom head and the jib support.

4. The jib attachment/detachment mechanism according to claim 2, wherein when the jib is mounted on the boom head by connecting the second connecting portion to the first connecting portion, the guide unit and the guided member are housed between the boom head and the jib support.

* * * * *